US012708832B1

(12) United States Patent
Dipert et al.

(10) Patent No.: US 12,708,832 B1
(45) Date of Patent: Aug. 18, 2026

(54) GOLF DATA INTEGRATION SYSTEMS AND METHODS

(71) Applicant: Taylor Made Golf Company, Inc., Carlsbad, CA (US)

(72) Inventors: Joshua Dipert, Carlsbad, CA (US); Brian M. Rahman, Carlsbad, CA (US); Mikhail Todes, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 128 days.

(21) Appl. No.: 18/413,935

(22) Filed: Jan. 16, 2024

Related U.S. Application Data

(60) Provisional application No. 63/581,155, filed on Sep. 7, 2023, provisional application No. 63/480,223, filed on Jan. 17, 2023.

(51) Int. Cl.

| | |
|---|---|
| ***A63B 71/06*** | (2006.01) |
| ***A63B 24/00*** | (2006.01) |
| ***A63B 43/00*** | (2006.01) |
| ***A63B 60/46*** | (2015.01) |
| *A63B 102/32* | (2015.01) |

(52) U.S. Cl.

CPC ..... *A63B 71/0669* (2013.01); *A63B 24/0062* (2013.01); *A63B 43/004* (2013.01); *A63B 60/46* (2015.10); *A63B 2024/0053* (2013.01); *A63B 2102/32* (2015.10); *A63B 2220/17* (2013.01); *A63B 2220/40* (2013.01); *A63B 2220/833* (2013.01); *A63B 2225/54* (2013.01)

(58) Field of Classification Search
None
See application file for complete search history.

(56) References Cited

U.S. PATENT DOCUMENTS

| | | | | |
|---|---|---|---|---|
| 5,370,389 | A | 12/1994 | Reising | |
| 6,203,443 | B1 | 3/2001 | Britton | |
| 9,211,439 | B1 | 12/2015 | Pedenko et al. | |
| 10,213,645 | B1 | 2/2019 | Wu et al. | |
| 10,350,455 | B2 | 7/2019 | Bentley et al. | |
| 10,589,162 | B2 * | 3/2020 | Koo | A63B 69/00 |
| 11,607,601 | B1 * | 3/2023 | Lovell | A63B 71/0669 |
| 11,701,555 | B2 | 7/2023 | Greaney et al. | |

(Continued)

FOREIGN PATENT DOCUMENTS

| | | | |
|---|---|---|---|
| AU | 2011293130 | B2 | 3/2016 |
| AU | 2013251335 | B2 | 8/2016 |

(Continued)

*Primary Examiner* — Seng H Lim
(74) *Attorney, Agent, or Firm* — Sterne, Kessler, Goldstein & Fox P.L.L.C.

(57) ABSTRACT

Data integration systems and methods for integrating and displaying data collected from one or more of a player device, a golf ball, or a golf hole. In some embodiments, the systems and methods can receive golf club data from the player device, and receive golf ball data from a golf ball, receive golf ball positional data from a position sensor, or both, and integrate the data received. In some embodiments, the integrated data can be displayed on the display screen of a player device. In some embodiments, the integrated data can be used to track a player's performance with different golf clubs. In some embodiments, the integrated data can be used to track a player's performance at a golf entertainment venue.

19 Claims, 14 Drawing Sheets

(56) References Cited

U.S. PATENT DOCUMENTS

| | | | | |
|---|---|---|---|---|
| 11,731,014 | B2 | 8/2023 | Greaney et al. | |
| 2003/0004005 | A1* | 1/2003 | Ainsworth | A63B 71/0605 473/151 |
| 2005/0227792 | A1* | 10/2005 | McCreary | A63B 24/0021 473/409 |
| 2008/0207357 | A1* | 8/2008 | Savarese | A63B 43/00 702/158 |
| 2008/0235934 | A1 | 10/2008 | Burnett et al. | |
| 2009/0017944 | A1* | 1/2009 | Savarese | G01S 13/56 473/409 |
| 2012/0052967 | A1* | 3/2012 | Grieshaber | A63B 63/00 473/409 |
| 2012/0056721 | A1* | 3/2012 | Luciano, Jr. | G01S 13/878 340/10.1 |
| 2013/0196787 | A1* | 8/2013 | Luciano, Jr. | A63B 43/004 473/371 |
| 2013/0296078 | A1 | 11/2013 | Solheim et al. | |
| 2018/0071582 | A1 | 3/2018 | Bentley et al. | |
| 2018/0318644 | A1 | 11/2018 | Forsgren | |
| 2019/0134506 | A1* | 5/2019 | Gupta | G09B 19/0038 |
| 2020/0078639 | A1 | 3/2020 | Niegowski et al. | |
| 2020/0155899 | A1 | 5/2020 | Hixenbaugh et al. | |
| 2020/0330830 | A1* | 10/2020 | Carew-Jones | A63B 43/004 |
| 2021/0069548 | A1 | 3/2021 | Beach et al. | |
| 2022/0126187 | A1* | 4/2022 | Hong | G06Q 50/10 |
| 2022/0339513 | A1 | 10/2022 | Beach et al. | |
| 2023/0125095 | A1* | 4/2023 | Chu | A63B 45/00 473/199 |

FOREIGN PATENT DOCUMENTS

| | | | |
|---|---|---|---|
| AU | 2011313952 | B2 | 4/2017 |
| AU | 2016204553 | B2 | 5/2017 |
| AU | 2012345966 | B2 | 2/2018 |
| AU | 2013209683 | B2 | 6/2018 |
| AU | 2015249884 | B2 | 7/2019 |
| AU | 2015249898 | B2 | 7/2019 |
| AU | 2016293616 | B2 | 3/2020 |
| AU | 2015349817 | B2 | 6/2020 |
| AU | 2017326614 | B2 | 1/2021 |
| AU | 2016293613 | B2 | 11/2021 |
| CA | 2917542 | A1 | 10/2015 |
| CA | 3005716 | A1 | 5/2016 |
| CA | 2812734 | C | 9/2017 |
| CA | 3040149 | A1 | 3/2018 |
| CA | 2865338 | C | 6/2019 |
| CA | 2875499 | C | 11/2019 |
| CA | 3030958 | C | 11/2019 |
| CA | 2862209 | C | 1/2020 |
| CA | 2817875 | C | 8/2020 |
| CA | 3031040 | C | 2/2021 |
| CA | 2983574 | C | 11/2021 |
| CN | 107211109 | B | 10/2018 |
| CN | 106574830 | B | 6/2019 |
| CN | 106464848 | B | 7/2019 |
| CN | 108028902 | B | 5/2021 |
| CN | 108369646 | B | 10/2021 |
| EP | 3017598 | A1 | 5/2016 |
| EP | 2842131 | B1 | 11/2016 |
| EP | 3323084 | A1 | 5/2018 |
| EP | 2804678 | B1 | 12/2018 |
| EP | 3134705 | B1 | 6/2019 |
| EP | 3513356 | A1 | 7/2019 |
| EP | 3710982 | A1 | 9/2020 |
| EP | 2785424 | B1 | 10/2020 |
| EP | 2609568 | B1 | 3/2021 |
| EP | 2628101 | B1 | 4/2021 |
| EP | 3323240 | B1 | 4/2021 |
| EP | 3222039 | B1 | 5/2021 |
| JP | 6147446 | B1 | 6/2017 |
| JP | 2017518488 | A | 7/2017 |
| JP | 2017521017 | A | 7/2017 |
| JP | 2018504802 | A | 2/2018 |
| JP | 2018523868 | A | 8/2018 |
| JP | 2018530804 | A | 10/2018 |
| JP | 6814196 | B2 | 1/2021 |
| JP | 2021503340 | A | 2/2021 |
| WO | WO-2014144824 | A1 | 9/2014 |

* cited by examiner 700 702 704 706 708

Player Name

| Club | | | Ball Position | | Ball Lauch | | Swing | | |
|---|---|---|---|---|---|---|---|---|---|
| Club Type | Alignment Feature Type | Number of Shots | Avg.Total Distance (ft) | Number of Balls Made | Spin | Trajectory | Lie Angle @ Impact | Loft Angle @ Impact | Face Angle @ Impact |
| Pa | 5A | 50 | 1.5 | 10 | 1 | 1° | 0° | 0° | 1° |
| Pa | 5C | 87 | 2 | 13 | 1 | 3° | 2° | 2° | 3° |
| Pb | 7K | 213 | 1 | 103 | 2 | 0° | 1° | 1° | 0° |
| Pc | 7K | 187 | 3 | 96 | 1 | 2° | 4° | 4° | -1° |
| Pd | 7K | 133 | 4.4 | 55 | 2 | 2° | 1° | -1° | 4° |
| Pd | 7M | 88 | 2.3 | 21 | 1 | 3° | 3° | 3° | 1° |
| Wa | * | 101 | 5 | 10 | 3 | 1° | 2° | 2° | 0° |
| Wb | * | 75 | 6.5 | 8 | 1 | 1° | 1° | -2° | 1° |

701 710 712 703

FIG. 7

1000

Score Card/Leader Board

1010

1012

| Player | Hole 1 | Hole 2 | Hole 3 | ··· | Total | Longest Shot Made (ft) |
|---|---|---|---|---|---|---|
| A | 3 | 2 | 1 | ··· | 50 | 55 |
| B | 4 | 2 | 2 | ··· | 54 | 22 |
| C | 2 | 3 | 2 | ··· | 52 | 30 |
| D | 4 | 5 | 1 | ··· | 59 | 50 |

701

Player A Stats

| Club | | | Ball Position | | Ball Lauch | | Swing | | |
|---|---|---|---|---|---|---|---|---|---|
| Club Type | Alignment Feature Type | Number of Shots | Avg.Total Distance (ft) | Number of Balls Made | Spin | Trajectory | Lie Angle @ Impact | Loft Angle @ Impact | Face Angle @ Impact |
| Pa | 5A | 18 | 1.5 | 5 | 1 | 1° | 0° | 0° | 1° |

FIG. 10

GOLF DATA INTEGRATION SYSTEMS AND METHODS

CROSS REFERENCE TO RELATED APPLICATIONS

This application claims the benefit of U.S. Provisional Application No. 63/480,223, filed on Jan. 17, 2023, and U.S. Provisional Application No. 63/581,155, filed on Sep. 7, 2023, both of which is incorporated herein by reference in its entirety.

BACKGROUND

Sports enthusiasts may desire to improve their performance through repeated practice and proper equipment fitting. For example, a golfer may hit golf balls at a putting green, a driving range and/or into a golf simulator. The golfer may want to assess each shot to fine-tune performance. Likewise, equipment fitters may also be interested in one or more properties of a golfer's swing and a club's interaction with the golf ball in order to select and fit equipment to the golfer. A launch monitor or other device may be used to assess performance and evaluate a golfer's swing by measuring one or more properties during a golf swing, such as when a golf ball is struck. For example, the launch monitor can be used to measure or model ball speed, club head speed, launch angle, club path, club face orientation, and other launch and swing properties captured during the golf swing.

In addition, golf related venues have been developed to allow players to practice different golf shots without having to be on a traditional golf course. These venues can include driving ranges, chipping areas, and/or putting greens to provide some examples to allow players to practice different long, medium, and/or short-range golf shots. In some cases, these venues have developed different types of golf-related games that have attracted a wide variety of players. In some cases, players can accumulate points while playing these golf-related games and the player with the most points at the conclusion of the golf-related games can be declared the winner.

BRIEF SUMMARY

The present disclosure describes systems and methods for integrating data collected before, during, and/or after a golf shot. The integrated data can comprise data transmitted from a player device, data transmitted from a golf ball, data transmitted from a golf hole, or a combination thereof. The data can be collected, integrated, and displayed for a player. The integrated data can be used by the player to assess, for example, their golf shots or the golf club used to hit the golf shots. In some embodiments, the data can be utilized to provide a club recommendation for the player. In some embodiments, the integrated data can be used to track a player's score or performance at a golf venue.

Some embodiments are directed to a system for integrating golf data, the system comprising a player device comprising a display screen; a golf ball comprising a ball transmitter, a position sensor, or both; and a computer comprising one or more processors configured to execute instructions, the instructions, when executed by the computer, configuring the computer to receive golf club data from the player device, receive golf ball data from the golf ball, receive golf ball positional data from the position sensor, or both, integrate the golf club data with the golf ball data, the golf ball positional data, or both, and display the integrated data on the display screen of the player device.

In some embodiments, the system comprises the golf ball, the golf ball comprises a ball sensor configured to sense when the golf ball falls into a golf hole, and the integrated data comprises a number of golf balls made in the golf hole.

In some embodiments, the golf club data comprises one or more of: a club type or an alignment feature type, and the integrated data comprises the number of golf balls made in the golf hole and one of more of: the club type or the alignment feature type.

In some embodiments, the system comprises the golf ball, the golf ball comprises a ball sensor configured to measure one of more of: a spin of the ball after impact with a golf club, a trajectory of the ball after impact with a golf club, or a velocity of the ball after impact with a golf club by capturing spin, trajectory, or velocity data immediately after an impact between the golf ball and a club face, the golf club data comprises one or more of: a club type or an alignment feature type, and the integrated data comprises: one or more of: the spin of the ball after impact with a golf club, the trajectory of the ball after impact with a golf club, or the velocity of the ball after impact with a golf club, and one or more of: the club type or the alignment feature type.

In some embodiments, the system comprises the golf ball and the position sensor, and the computer is configured to receive both the golf ball data and the golf ball positional data.

In some embodiments, the computer is configured to integrate the golf ball data and the positional data, and the integrated data comprises one or more of: a number of golf balls made in a golf hole, an average total distance between a golf hole and one or more golf balls, an average lateral distance between a golf hole and one or more golf balls, or an average vertical distance between a golf hole and one or more golf balls.

In some embodiments, the golf ball comprises a ball sensor configured to measure one of more of: a spin of the ball after impact with a golf club, a trajectory of the ball after impact with a golf club, or a velocity of the ball after impact with a golf club by capturing spin, trajectory, or velocity data immediately after an impact between the golf ball and a club face.

In some embodiments, the integrated data comprises one or more of: the number of golf balls made in a golf hole, the average total distance between a golf hole and one or more golf balls, the average lateral distance between a golf hole and one or more golf balls, or the average vertical distance between a golf hole and one or more golf balls, and one or more of: the spin of the ball after impact with a golf club, the trajectory of the ball after impact with a golf club, or the velocity of the ball after impact.

In some embodiments, the golf club data comprises one or more of: a club type or an alignment feature type.

In some embodiments, the integrated data comprises one or more of: the number of golf balls made in a golf hole, the average total distance between a golf hole and one or more golf balls, the average lateral distance between a golf hole and one or more golf balls, or the average vertical distance between a golf hole and one or more golf balls, and one or more of: the club type or the alignment feature type.

In some embodiments, the golf ball comprises a ball sensor configured to measure one of more of: a spin of the ball after impact with a golf club, a trajectory of the ball after impact with a golf club, or a velocity of the ball after impact with a golf club by capturing spin, trajectory, or velocity data immediately after an impact between the golf ball and a club face, and the integrated data further comprises one or more of: the spin of the ball after impact with a golf club, the trajectory of the ball after impact with a golf club, or the velocity of the ball after impact.

In some embodiments, the golf ball comprises a ball sensor configured to measure one of more of: a spin of the ball after impact with a golf club, a trajectory of the ball after impact with a golf club, or a velocity of the ball after impact with a golf club by capturing spin, trajectory, or velocity data immediately after an impact between the golf ball and a club face, the golf club data comprises one or more of: a club type or an alignment feature type, and the integrated data comprises one or more of: the spin of the ball after impact with a golf club, the trajectory of the ball after impact with a golf club, or the velocity of the ball after impact, and one or more of: the club type or the alignment feature type.

In some embodiments, the player device is a golf club further comprising a club sensor.

In some embodiments, the club sensor comprises an IMU sensor configured to measure one or more of: a golf club lie angle at address, a golf club loft angle at address, a golf club face angle at address, a golf club lie angle at impact with a golf ball, a golf club loft angle at impact with a golf ball, a golf club face angle at impact with a golf ball, a golf club swing path, a swing tempo, a back swing duration, a swing transition rate, a swing width, or a club head rotation.

In some embodiments, the integrated data further comprises one or more of: the golf club lie angle at address, the golf club loft angle at address, the golf club face angle at address, the golf club lie angle at impact with a golf ball, the golf club loft angle at impact with a golf ball, the golf club face angle at impact with a golf ball, the golf club swing path, the swing tempo, the back swing duration, the swing transition rate, the swing width, or the club head rotation.

In some embodiments, the player device is a golf club.

In some embodiments, the golf club is a putter.

In some embodiments, the display screen of the player device is configured to display a plurality of different alignment features.

In some embodiments, the player device is a mobile computing device carried by a player.

In some embodiments, the system further comprises a golf club comprising a club sensor configured to measure swing data for the player's golf swing, and a club transmitter configured to transmit the swing data to the player device.

In some embodiments, the club sensor comprises an IMU sensor and the swing data comprises one or more of: a golf club lie angle at address, a golf club loft angle at address, a golf club face angle at address, a golf club lie angle at impact with a golf ball, a golf club loft angle at impact with a golf ball, a golf club face angle at impact with a golf ball, a golf club swing path, a swing tempo, a back swing duration, a swing transition rate, a swing width, or a club head rotation.

In some embodiments, the integrated data further comprises one or more of: the golf club lie angle at address, the golf club loft angle at address, the golf club face angle at address, the golf club lie angle at impact with a golf ball, the golf club loft angle at impact with a golf ball, the golf club face angle at impact with a golf ball, the golf club swing path, the swing tempo, the back swing duration, the swing transition rate, the swing width, or the club head rotation.

In some embodiments, the golf club comprises a second display screen configured to display a plurality of different alignment features.

In some embodiments, the position sensor comprises an optical camera, a radar camera, or a LiDAR camera.

In some embodiments, the golf ball positional data comprises data indicating a distance between the hole and the player device.

In some embodiments, the golf ball positional data comprises data indicating a distance between the ball and the hole.

In some embodiments, the system further comprises a launch monitor configured to capture golf ball shot characteristics during a golf swing, and the computer is configured to integrate: the club data, the golf ball data, the golf ball positional data, and the golf ball characteristics.

In some embodiments, the system further comprises a motion sensor configured to capture motion-based golf swing characteristics during a golf swing, and the computer is configured to integrate: the club data, the golf ball data, the golf ball positional data, and the motion-based golf club characteristics.

In some embodiments, the computer is further configured to display a recommendation on the display screen.

In some embodiments, the recommendation is a golf club fitting recommendation.

In some embodiments, the recommendation is a golf swing technique, a golf training drill, or both.

Some embodiments are directed to a method of integrating golf data, the method comprising receiving golf club data at a player device comprising a display screen; wirelessly receiving, at the player device, golf ball data from a golf ball transmitter located within a golf ball; wirelessly receiving, at the player device, golf ball positional data from a position sensor disposed at a golf hole; integrating the golf club data with the golf ball data, the golf ball positional data, or both; and displaying the integrated data on the display screen of the player device.

Some embodiments are directed to a system for integrating data at a golf entertainment venue, the system comprising a plurality of teeing areas, each of the respective teeing areas comprising a respective teeing area transmitter; a plurality of golf holes, each of the respective golf holes comprising a respective hole transmitter; a plurality of golf balls, each golf ball comprising a golf ball identifier; one or more memories that store a golf ball registration database, the golf ball registration database comprising each of the golf ball identifiers; and one or more processors configured to execute instructions stored in the memory, the instructions, when executed by the one or more processors, configuring the one or more processors to: register a first one of the golf ball identifiers with a first player at the golf entertainment venue; identify, by data received from a first one of the teeing area transmitters, the first golf ball identifier at a first one of the teeing areas within the golf entertainment venue; identify, by data received from a first one of the hole transmitters, the first golf ball identifier at a first one of the golf holes within the golf entertainment venue; receive a number of strokes taken between the first teeing area and the first golf hole; and display, on a display screen of a player device, the first player's score based on the number of strokes taken between the first teeing area and the first golf hole.

In some embodiments, the instructions, when executed by the one or more processors, configure the one or more processors to: identify, by data received from a second one of the teeing area transmitters, the first golf ball identifier at a second one of the teeing areas within the golf entertainment venue; identify, by data received from a second one of the hole transmitters, the first golf ball identifier at a second one of the golf holes within the golf entertainment venue; receive a number of strokes taken between the second teeing area and the second golf hole; and display, on the display screen of the player device, the first player's score based on the number of strokes taken between the second teeing area and the second golf hole.

In some embodiments, the number of strokes taken between the first teeing area and the first golf hole is calculated by an IMU sensor located within the golf ball comprising the first golf ball identifier, and a ball transmitter located within the golf ball comprising the first golf ball identifier transmits the number of strokes taken between the first teeing area and the first golf hole to a receiver located at the first golf hole.

In some embodiments, the system comprises a proximity sensor system configured to determine changes in a resting location of the golf ball comprising the first golf ball identifier, and the number of strokes taken between the first teeing area and the first golf hole is calculated by determining changes in the resting location.

In some embodiments, the proximity sensor system comprises a plurality of radio-frequency proximity sensors arranged in a grid between the first teeing area and the first golf hole.

In some embodiments, the system further comprises a computer comprising one or more processors configured to execute instructions, the instructions, when executed by the computer, configuring the computer to: receive golf club data from the player device, receive golf ball data from the golf ball comprising the first golf ball identifier, receive golf ball positional data from a position sensor, or both, integrate the golf club data with the golf ball data, the golf ball positional data, or both, and display the integrated data on the display screen of the player device.

In some embodiments, the player device is a mobile computing device carried by a player.

In some embodiments, the system further comprises a golf club carried by the first player, the golf club comprising a club sensor configured to measure swing data for the player's golf swing, and a club transmitter configured to transmit the swing data to the player device.

In some embodiments, the club sensor comprises an IMU sensor and the swing data comprises one or more of: a golf club lie angle at address, a golf club loft angle at address, a golf club face angle at address, a golf club lie angle at impact with a golf ball, a golf club loft angle at impact with a golf ball, a golf club face angle at impact with a golf ball, a golf club swing path, a swing tempo, a back swing duration, a swing transition rate, a swing width, or a club head rotation.

In some embodiments, the integrated data further comprises one or more of: the golf club lie angle at address, the golf club loft angle at address, the golf club face angle at address, the golf club lie angle at impact with a golf ball, the golf club loft angle at impact with a golf ball, the golf club face angle at impact with a golf ball, the golf club swing path, the swing tempo, the back swing duration, the swing transition rate, the swing width, or the club head rotation.

In some embodiments, the data received from the hole transmitter comprises data indicating a distance between the ball comprising the first golf ball identifier and the first golf hole.

In some embodiments, the hole transmitter is disposed in the golf hole.

In some embodiments, the hole transmitter is coupled a flag disposed in the golf hole.

In some embodiments, the golf ball identifiers comprise an NFC chip, and each of the plurality of golf holes comprises an NFC receiver configured to read an NFC signal from the NFC chip of each golf ball.

In some embodiments, the system comprises a proximity sensor system comprising a plurality of NFC sensors configured to determine changes in a resting location of the plurality of golf balls, and the number of strokes taken between the first teeing area and the first golf hole is calculated by determining changes in the resting location by sensing the NFC chip of the golf ball comprising the first golf ball identifier at one or more of the plurality of NFC sensors.

Some embodiments are directed to a system for integrating data at a golf entertainment venue, the system comprising a plurality of golf balls, each golf ball comprising a golf ball identifier comprising an NFC chip; a plurality of teeing areas, each of the respective teeing areas comprising: a respective teeing area NFC receiver configured to read the NFC chips and a respective teeing area transmitter; a plurality of golf holes, each of the respective golf holes comprising: a respective hole NFC receiver configured to read the NFC chips and a respective hole transmitter; one or more memories that store a golf ball registration database, the golf ball registration database comprising each of the golf ball identifiers; and one or more processors configured to execute instructions stored in the memory, the instructions, when executed by the one or more processors, configuring the one or more processors to: register a first one of the golf ball identifiers with a first player at the golf entertainment venue; identify, by data received from a first one of the teeing area transmitters, the first golf ball identifier at a first one of the teeing areas within the golf entertainment venue; identify, by data received from a first one of the hole transmitters, the first golf ball identifier at a first one of the golf holes within the golf entertainment venue; receive a number of strokes taken between the first teeing area and the first golf hole; and display, on a display screen of a player device, the first player's score based on the number of strokes taken between the first teeing area and the first golf hole.

In some embodiments, the system comprises a proximity sensor system comprising a plurality of NFC sensors configured to determine changes in a resting location of the plurality of golf balls, and the number of strokes taken between the first teeing area and the first golf hole is calculated by determining changes in the resting location by sensing the NFC chip of the golf ball comprising the first golf ball identifier at one or more of the plurality of NFC sensors.

In some embodiments, the number of strokes taken between the first teeing area and the first golf hole is calculated by an IMU sensor located within the golf ball comprising the first golf ball identifier, and a ball transmitter located within the golf ball comprising the first golf ball identifier transmits the number of strokes taken between the first teeing area and the first golf hole to a receiver located at the first golf hole.

In some embodiments, the system comprises a charging bin comprising a plurality of NFC chargers configured to charge the NFC chip and the IMU sensor of each of the plurality of golf balls.

BRIEF DESCRIPTION OF THE DRAWINGS/FIGURES

The accompanying figures, which are incorporated herein, form part of the specification and illustrate embodiments of the present disclosure. Together with the description, the figures further serve to explain the principles of and to enable a person skilled in the relevant art(s) to make and use the disclosed embodiments. These figures are intended to be illustrative, not limiting. Although the disclosure is generally described in the context of these embodiments, it should be understood that it is not intended to limit the scope of the disclosure to these particular embodiments. In the drawings, like reference numbers indicate identical or functionally similar elements.

FIG. 7 illustrates a display showing integrated data according to some embodiments.

FIG. 10 illustrates a display showing integrated data according to some embodiments.

In the accompanying drawings, like reference numbers indicate identical or functionally similar elements.

DETAILED DESCRIPTION

Systems and methods described herein are directed to measuring, integrating, and leveraging various data measurements captured before, during, and after a golf shot. More specifically, this disclosure pertains to measuring, integrating, and leveraging one or more of golf club data, golf ball data, golf ball positional data, and/or golf swing characteristics. The data can be collected using various input devices, for example, user input devices and sensors. The collected data can be transmitted to a player device or a host computer, and integrated to create one or more reports for a player. The report can be, for example, an electronic report displayed on an electronic display screen of the player device. The display can present the integrated data to a player in one or more useful formats. In some embodiments, the display can present a recommendation to the player based on the integrated data.

Systems and methods described herein can aggregate data and/or measurements captured by different technologies before, during, or after a golf shot. By capturing measurements using different technologies, the systems and methods described herein can integrate the data and display such data to a player in one or more useful formats. By integrating data received from different devices, additional features and functionalities can be provided to the player that the individual devices could not provide on their own. Additionally, by integrating data as described herein, golfers, club fitters, instructors, and other individuals can access and leverage the integrated data to better understand a player's golf swing, and in some embodiments, provide improved recommendations to the player. In some embodiments, systems and methods described herein can be used to provide club fitting analysis and/or recommendations to a player. For example, systems and methods described herein can be used to provide putter fitting analysis and/or recommendations to a player.

Systems and methods described herein can additionally or alternatively collect data to track a player at a golf entertainment venue. In some embodiments, the data can be used to track a player's score at a golf entertainment venue. In some embodiments, the data used to track a player's score can be integrated with one or more of golf club data, golf ball data, golf ball positional data, and/or golf swing characteristics. In such embodiments, tracking a player at the golf entertainment venue can comprise tracking the player's performance at the venue. In some embodiments, data for multiple players at a venue can be tracked. In such embodiments, the systems and methods described herein can track a plurality of players' scores, a plurality of players' performance, or both, and display integrated data for the plurality of players.

Figure 1:
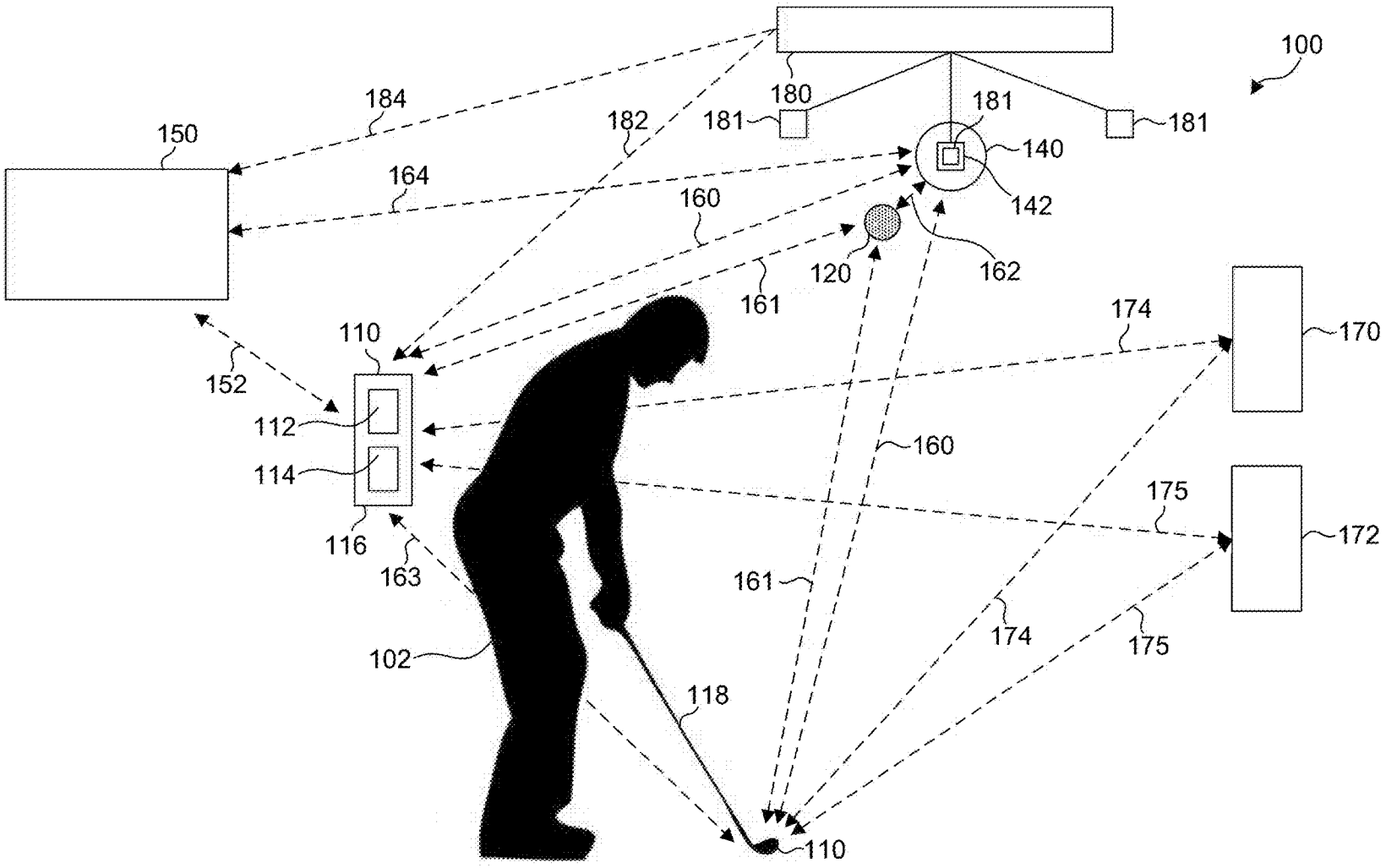
FIG. 1 illustrates a data integration system according to some embodiments.

FIG. 1 illustrates a system 100 according to some embodiments. System 100 comprises one or more player devices 110, one or more golf balls 120, and one or more golf holes 140. Player device(s) 110, golf ball(s) 120, and golf hole(s) 140 are configured to communicate via one or more communication paths 160, 161, 162, 163, 164 within system 100. Communication path 160 can be a wireless communication path between an electronic module 142 of a golf hole 140 and a player device 110. Communication path 161 can be a wireless communication path between an electronic module 122 of a golf ball 120 and a player device 110. Communication path 162 can be a wireless communication path between an electronic module 122 of a golf ball 120 and an electronic module 142 of a golf hole 140. Communication path 163 can be a wireless communication path between a golf club 118 and a mobile computing device 116. Wireless communication paths can utilize any suitable wireless communication method, such as radio-frequency communication, near-field-communication (NFC), BLUETOOTH®, Wi-Fi, ultra-wideband (UWB) communication, or another suitable communication protocol.

In some embodiments, system 100 can comprise one or more position sensors 180 configured to determine the distance between a golf ball 120 and a golf hole 140, the distance between a player device 110 and a golf hole 140, the distance between the golf ball 120 and the player device 110, or a combination thereof. Suitable position sensor(s) 180 comprise, but are not limited to an optical camera, a radar camera, a LiDAR camera, or an array of radio-frequency position sensors, for example ultra-wideband (UWB) sensors. Exemplary optical cameras comprise, but are not limited to, digital cameras, such as Nikon D800 D-SLR cameras. In embodiments comprising position sensor(s) 180, the position sensor(s) 180 can have a field of view surrounding an individual golf hole 140. As used in herein, the term "field of view" means an area within which one or more position sensors are capable of determining the position of an object. For example, the field of view for an optical camera can be the area the camera is capable of imaging. As another example, the field of view for an array of sensors can be the area covered by the combined communication range area of each sensor in the array.

In some embodiments, position sensor(s) 180 can be configured to communicate with player device(s) 110 via communication path 182. In some embodiments, position sensor(s) 180 can be configured to communicate with a host computer 150 via communication path 184. Communication paths 182, 184 can be a wired or wireless communication path between a position sensor 180 and a player device 110 or host computer 150, respectively. Suitable wired or wireless communication methods comprise Universal Serial Bus (USB), BLUETOOTH®, Wi-Fi, or another communication protocol. In some embodiments, multiple different communication protocols can be used concurrently.

In embodiments comprising an array of position sensors, position sensor 180 can comprise a plurality of radio-frequency position sensors 181 located around golf hole 140 and electronic modules 122 of golf balls 120 can comprise a corresponding position sensor configured to communicate with each of the plurality of radio-frequency position sensors 181. In such embodiments, each radio-frequency position sensor 181 can communicate with the corresponding position sensor of a ball 120 to determine the location of ball 120 around hole 140. As described herein, the array of radio-frequency positions sensors 181 can determine the position of ball 120 relative to hole 140 by multilateration. In some embodiments, the array of radio-frequency position sensors 181 can comprise a radio-frequency position sensor located at or within hole 140. In such embodiments, an electronic module 142 of golf hole 140 can comprise a radio-frequency position sensor 181.

In embodiments comprising an array of position sensors, position sensor 180 can comprise a plurality of radio-frequency position sensors 181 located around golf hole 140 and player device 110 can comprise a corresponding position sensor configured to communicate with each of the plurality of radio-frequency positions sensors 181. In such embodiments, each radio-frequency position sensor 181 can communicate with the corresponding radio-frequency position sensor of player device 110 to determine the location of player device 110 relative to hole 140. As described herein, the array of radio-frequency positions sensors 181 can determine the position of player device 110 relative to hole 140 by multilateration. In some embodiments, the array of radio-frequency position sensors 181 can comprise a radio-frequency position sensor located at or within hole 140. In such embodiments, an electronic module 142 of golf hole 140 can comprise a radio-frequency position sensor 181.

In some embodiments, an electronic module 142 of golf hole 140 can comprise a radio-frequency position sensor 181 and electronic modules 122 of golf balls 120 can comprise a corresponding radio-frequency position sensor configured to communicate with the radio-frequency position sensor 181 of golf hole 140. In such embodiments, the radio-frequency position sensor 181 of golf hole 140 can communicate with the corresponding radio-frequency position sensor of a ball 120 to determine the distance between ball 120 and hole 140.

In some embodiments, an electronic module 142 of golf hole 140 can comprise a radio-frequency position sensor 181, player device 110 can comprise a corresponding radio-frequency position sensor, and electronic modules 122 of golf balls 120 can comprise a corresponding radio-frequency position sensor configured to communicate with the radio-frequency position sensor 181 of golf hole 140 and the radio-frequency position sensor of player device 110. In such embodiments, the radio-frequency position sensor 181 of golf hole 140 can communicate with the corresponding radio-frequency position sensors of the ball 120 and the player device 110 to determine the distance between ball 120 and hole 140, and the distance between the player device 110 and the hole 140.

In some embodiments, golf hole(s) 140 can be configured to communicate with host computer 150 via communication path 164. In such embodiments, communication path can be a wired or wireless communication path between an electronic module 142 of a golf hole 140 and host computer 150. Host computer 150 can be communicatively coupled to golf hole(s) 140 using any suitable wired or wireless communication method, such as Universal Serial Bus (USB), BLUETOOTH®, Wi-Fi, or another communication protocol. In some embodiments, multiple different communication protocols can be used concurrently.

Player device(s) 110 comprise a computer 114 and a display screen 112. In some embodiments, a player device 110 can be a mobile computing device 116 carried by a player 102. In such embodiments, mobile computing device 116 can be, for example, a mobile phone or a tablet computer. In some embodiments, a player device 110 can be a golf club 118 carried by a player 102. In such embodiments, the golf club 118 can comprise an electronic club head comprising an electronic assembly, for example club head 400 comprising electronic assembly 404. In some embodiments, system 100 can comprise a mobile computing device 116 and a golf club 118 comprising an electronic club head. In some embodiments, golf club 118 can be a putter.

In some embodiments, golf club 118 can be a wedge, for example, a pitching wedge, a chipping wedge, a gap wedge, a sand wedge, or a lob wedge. In some embodiments, golf club 118 can be an iron comprising an iron type club head. In some embodiments, golf club 118 can be a wood, a utility club, or a driver.

Figure 3:
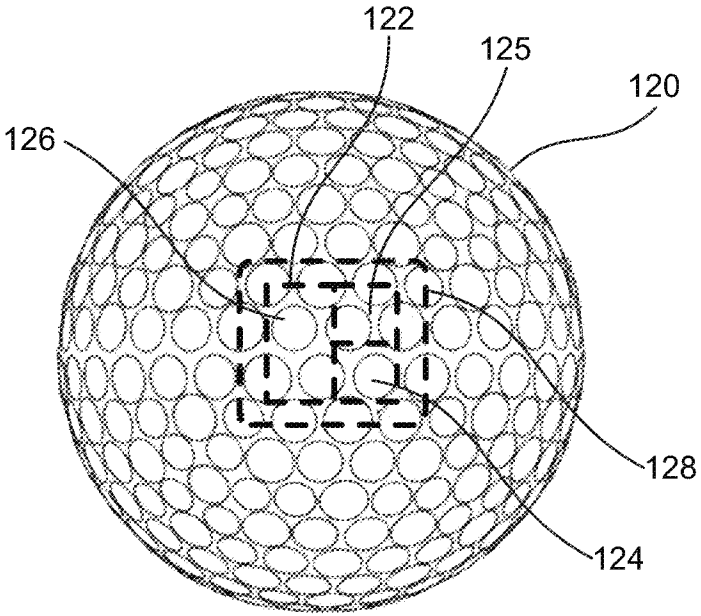
FIG. 3 illustrates a golf ball according to some embodiments.

As shown in FIG. 3, golf ball(s) 120 can comprise an electronic module 122. Electronic module 122 comprises a transmitter 124 for transmitting one or more signals from ball 120 to other components of system 100. Exemplary transmitters 124 for electronic module 122 comprise, but are not limited to, a radio-frequency transmitting device, a near-field-communication (NFC) transmitting device, a BLUETOOTH® transmitting device, a Wi-Fi transmitting device, an ultra-wideband (UWB) transmitting device, or a similar device for locally communicating with components of system 100.

In some embodiments, golf ball(s) 120 can comprise one or more sensors for measuring characteristics of ball 120. In some embodiments, the one or more sensors can comprise an inertial measuring unit (IMU) sensor 126. In such embodiments, IMU sensor 126 can comprise one or more motion sensors, one or more global positioning system (GPS) sensors, one or more accelerometers, one or more magnetometers, one or more gyroscopes, or a combination thereof.

In some embodiments, electronic module 122 can comprise a receiver 125 for receiving one or more signals from other components of system 100. Exemplary receivers 125 for electronic module 122 comprise, but are not limited to, a radio-frequency receiver, a near-field-communication (NFC) receiver, a BLUETOOTH® receiver, a Wi-Fi receiver, an ultra-wideband (UWB) receiver, or a similar device for locally communicating with components of system 100.

In some embodiments, golf ball(s) 120 can comprise an identifier 128 that uniquely identifies ball 120 to system 100. In some embodiments, identifier 128 can be an electronic identifier, such as a radio frequency identification (RFID) signal, an NFC signal, a Wi-Fi signal, an ultra-wideband (UWB) signal, or a BLUETOOTH® signal. In such embodiments, electronic module 122 can comprise the electronic identifier 128 in the form of an RFID chip, an NFC chip, a Wi-Fi chip, ultra-wideband (UWB) chip, or a BLUETOOTH® beacon. In some embodiments, identifier 128 can be an optically identifiable image, for example, a barcode, a quick response (QR) code, or a unique graphical image. Unique graphical images comprise, but are not limited to, the graphical images described in U.S. Pub. No. 2022/0339513, which is hereby incorporated by reference in its entirety.

Golf holes(s) 140 can comprise an electronic module 142. Electronic module 142 comprises a transmitter 144 for transmitting one or more signals from hole 140 to other components of system 100. Exemplary transmitters 144 for electronic module 142 comprise, but are not limited to, a radio-frequency transmitter, a near-field-communication (NFC) device, a BLUETOOTH® transmitting device, a Wi-Fi transmitting device, ultra-wideband (UWB) transmitting device, or a similar device for locally communicating with components of system 100.

In some embodiments, electronic module 142 can comprise a receiver 146 for receiving one or more signals from other components of system 100. Exemplary receivers 146 for electronic module 142 comprise, but are not limited to a radio-frequency receiver, a near-field-communication (NFC) receiver, a BLUETOOTH® receiver, a Wi-Fi receiver, an ultra-wideband (UWB) receiver, or a similar device for locally communicating with components of system 100.

In some embodiments, an electronic module 142 can be disposed in the golf hole 140. In some embodiments, transmitter 144 can be disposed in the golf hole 140. In some embodiments, an electronic module 142 can be coupled to a flag disposed in the golf hole 140. In some embodiments, transmitter 144 can be coupled a flag disposed in the golf hole 140.

In some embodiments, system 100 can comprise host computer 150. In such embodiments, host computer 150 can communicate with player device(s) 110 via a communication path 152. Host computer 150 can be any of a variety of computing devices, for example, a personal computer (PC), a laptop computer, a tablet, a smartphone, a cell phone, a personal digital assistant (PDA), a server computer. Host computer 150 can be communicatively coupled to player device(s) 110 using any suitable wired or wireless communication method, such as Universal Serial Bus (USB), BLUETOOTH®, Wi-Fi, or another communication protocol. In some embodiments, multiple different communication protocols can be used concurrently.

In some embodiments, system 100 can comprise a launch monitor 170. In such embodiments, launch monitor 170 can communicate with player device(s) 110 via a communication path 174. Player device(s) 110 can be communicatively coupled to launch monitor 170 using any suitable wired or wireless communication method, such as Universal Serial Bus (USB), BLUETOOTH®, Wi-Fi, or another communication protocol. In some embodiments, multiple different communication protocols can be used concurrently. In some embodiments, launch monitor 170 can communicate with host computer 150. Host computer 150 can be communicatively coupled to launch monitor 170 using any suitable wired or wireless communication method, such as Universal Serial Bus (USB), BLUETOOTH®, Wi-Fi, or another communication protocol. In some embodiments, multiple different communication protocols can be used concurrently.

Launch monitor 170, which can be placed behind, beside, above, or in another location with respect to a golf ball 120, provides a system of one or more sensors that capture measurements during a golf swing. For example, launch monitor 170 can capture a number of measurements based on monitoring the golf ball, the golf club, the golfer, or a combination thereof. For example, launch monitor 170 can measure or model one or more golf ball shot characteristics (for example, ball speed, club head speed, launch angle, spin, presented loft (at impact), presented lie, presented face angle, club path, ball path, carry distance, total distance, shot dispersion, and other measurements). Further, launch monitor 170 can calculate additional measurements, such as smash factor, which is calculated from ball speed and club head speed measurements.

In some embodiments, launch monitor 170 can be an optical launch monitor, and can use multiple cameras to capture the measurements during the golf swing. For example, GC Quad by Foresight Sports uses four cameras (i.e., quadrascopic) to capture measurements of the golf ball and the golf club during the golf swing. Other optical systems, such as GC2 by Foresight Sports, use fewer cameras, such as only two cameras (i.e., stereoscopic), and only capture measurements of the golf ball. In some embodiments, launch monitor 170 can be an optical launch monitor located above a player, for example a GCHawk from Foresight. Additional sensors can be provided to capture additional measurements, such as by providing additional cameras to capture golf club measurements (e.g., adding HMT (head measurement technology) by Foresight Sports to the GC2 launch monitor). During use, optical launch monitors can be placed beside the golf ball before the golf swing.

In some embodiments, launch monitor 170 can be a radar-based launch monitor, often referred to as Doppler or radar launch monitors. Radar launch monitors can use multiple radar systems to measure the golf ball, the golf club, or a combination thereof. For example, Trackman 4 by TrackMan Golf uses two radar systems (i.e., dual radar technology), with one radar system tracking movement of the golf club and one radar system tracking movement of the golf ball. During use, Doppler launch monitors can be placed behind the golf ball before the golf swing.

In some embodiments, system 100 can comprise a motion sensor 172. In such embodiments, motion sensor 172 can communicate with player device(s) 110 via a communication path 175. Player device(s) 110 can be communicatively coupled to motion sensor 172 using any suitable wired or wireless communication method, such as Universal Serial Bus (USB), BLUETOOTH®, Wi-Fi, or another communication protocol. In some embodiments, multiple different communication protocols can be used concurrently. In some embodiments, motion sensor 172 can communicate with host computer 150. Host computer 150 can be communicatively coupled to motion sensor 172 using any suitable wired or wireless communication method, such as Universal Serial Bus (USB), BLUETOOTH®, Wi-Fi, or another communication protocol. In some embodiments, multiple different communication protocols can be used concurrently.

Motion sensor 172 can comprise sensors to measure one or more motion-based golf swing characteristics of a player 102, a golf ball 120 or a golf club during a golf swing. For example, reflective markers can be placed on one or more of the golf club shaft (for example, on the butt end of the golf club grip to capture grip data and/or on the shaft between the grip and the club head to capture club shaft data), the golf club head to capture head data, or the body of the golfer to capture additional measurements. High speed cameras are then used to capture motion data based on how the markers move during the golf swing. This motion data can indicate a forward lean of the club shaft at impact, swing tempo, ball initial launch parameters, face angle, club path, and other metrics. As another example, a three-axis gyro sensor and an accelerometer can be used to capture golf club movement during a golf swing. In this example, a sensor mounts to the butt end of the golf club grip, and provides metrics on forward shaft lean at impact, swing tempo, ball initial launch parameters, face angle and other metrics. Body motion sensors can also be provided, which can use a vest and belt system for capturing and providing measurement of the golfer's shoulders and hips during the golf swing, such as tempo, body positions, wrist angles, peak swing speeds and swing sequencing.

One or more computers of system 100 are configured to integrate data received from various components of system 100. System 100 is also configured to display the integrated data to a player 102. In some embodiments, the integrated data can be displayed on display screen 112 of player device 110, a display screen of host computer 150, or both.

In some embodiments, the computer 114 of player device 110 can be configured to integrate the data received and display the integrated data on the display screen 112. In such embodiments, computer 114 comprises one or more processors configured to execute instructions, the instructions, when executed by computer 114, can configure the computer 114 to receive golf club data from the player device 110, and receive golf ball data from a golf ball 120, receive golf ball positional data from a position sensor 180, or both. After receiving the golf club data, and the golf ball data and/or golf ball positional data, the instructions can configure the computer 114 to integrate the golf club data with the golf ball data, the golf ball positional data, or both, and display the integrated data on the display screen 112 of the player device 110.

In some embodiments, host computer 150 can comprise one or more processors configured to execute instructions, the instructions, when executed by computer 150, can configure the computer 150 to receive golf club data from the player device 110, and receive golf ball data, receive golf ball positional data, or both. In some embodiments, after receiving the golf club data, and the golf ball data and/or golf ball positional data, the instructions can configure the computer 150 to integrate the golf club data with the golf ball data, the golf ball positional data, or both, and communicate the integrated data to the player device 110 for display on the display screen 112 of the player device 110. In some embodiments, after receiving the golf club data, and the golf ball data and/or golf ball positional data, the instructions can configure the computer 150 to integrate the golf club data with the golf ball data, the golf ball positional data, or both, and display the integrated data on a display screen of computer 150.

In embodiments including computer 150, computer 114 and computer 150 can be configured to work together as the computer that executes instructions to receive golf club data from the player device 110, and receive golf ball data from a golf ball 120 and receive golf ball positional data from a position sensor 180, or both. And after receiving the golf club data, and the golf ball data and/or golf ball positional data, integrate the golf club data with the golf ball data, the golf ball positional data, or both, and display the integrated data on a display screen.

In some embodiments, the integrated data can comprise the golf club data and the golf ball data. In some embodiments, the integrated data can comprise the golf club data and the golf ball positional data. In some embodiments, the integrated data can comprise the golf ball data and the golf ball positional data. In some embodiments, the integrated data can comprise the golf club data, the golf ball data, and the golf ball positional data.

Golf club data can be received at player device 110 via one or more inputs (for example, user interface input devices 1122 or storage subsystem 1124) on the player device 110. In some embodiments, the golf club data can be input manually by a player 102 at the player device 110. In some embodiments, golf club data can be automatically input or downloaded by computer 114 of player device 110. For example, the selected alignment feature type for club head 400 can be automatically received from a memory (for example, storage subsystem 1124) of player device 110.

Golf club data that can be received at player device 110 comprises, but is not limited to, a club type, an alignment feature type, a club property, or a combination thereof. Exemplary club types comprise (i) a type of club (for example, a putter, a chipping wedge, a gap wedge, a lob wedge, a sand wedge, an iron, a wood, or a driver), (ii) a brand of club (for example, TAYLORMADE®), (iii) a club model (for example, a TAYLORMADE® Spider putter, a TAYLORMADE® TP Hydro Blast putter, a TAYLORMADE® MYMG3 wedge, or a TAYLORMADE® MyHi-Toc 3 wedge), or (iv) a combination thereof. Exemplary alignment features comprise any of the alignment features 520 shown in FIGS. 5A-5O.

Exemplary club properties comprise, but are not limited to, a club head mass, a club head volume, a club head address area, a club head center of gravity (CG) x-axis coordinate (CGx), a club head CG y-axis coordinate (CGy), a club head CG z-axis coordinate (CGz), a moment of inertia about a club head CG x-axis (Ixx), a moment of inertia about a club head CG y-axis (Iyy), a moment of inertia about a club head CG z-axis (Izz), a club head length, a club head loft angle, a club head lie angle, a club head face angle, a club head swing weight, a club head stock keeping unit (SKU), a club head toe hang parameter, a club head presented lie angle, a club head score line presented lie, a club head presented face angle, a club head presented loft angle, a club head bulge radius, a club head roll radius, a club head sole radius, a club head face height, club head face width, a club head face length, a club head face area, a club head face progression, a club head height, a club head length, a hosel diameter, a hosel taper length, an iron or wedge blade length, a club face thickness, a club face area, a club face variable thickness parameter, a club head base hosel length, an iron or wedge leading edge radius, an iron or wedge leading edge belly, an iron or wedge blade sole camber, a club head bounce, a putter neck type, a putter toe hang type, a shaft brand, a shaft model, a shaft frequency, a shaft weight, a shaft swing weight, a shaft CG location, a shaft moment of inertia, a shaft flex characteristic (for example, a shaft butt flex or a shaft tip flex), a shaft kick point, a shaft torque, a shaft butt outer diameter, a shaft SKU, a grip mass, a grip size, a grip CG, a grip butt thickness, a grip length, a grip SKU, a grip brand, and a grip model.

Unless specified otherwise, for the club properties discussed above, an x-axis is an axis extending from a heel side to a toe side of the club head, a y-axis is an axis extending from a club face to a rear side of the club head, and a z-axis is an axis extending from a sole to a crown of the club head.

In some embodiments, golf club data received at player device 110 can comprise a number of golf shots hit with a particular club type and/or alignment feature. In some embodiments, the number of golf shots can be determined by detecting an impact between a ball 120 and a club face. Detecting an impact can be performed by an IMU sensor 126, an IMU sensor of an electronic assembly 404 in a club head, or both. In some embodiments, the number of golf shots can be determined by setting a particular time session during which a particular club type and/or alignment feature is being used by player 102 to hit golf shots. For example, player 102 can manually change from a first time session during which a first club type is being used to a second time session during which a second club type is being used. During each respective time session, system 100 can determine the number golf shots by determining, based on positional data described below, how many golf balls 120 come to rest for more than a predetermined amount of time during the session.

Golf ball data that can be received at player device 110 comprises, but is not limited to, ball launch data, golf ball positional data, or both.

In some embodiments, golf ball data from a golf ball 120 can be received at player device 110 via communication path 161. In such embodiments, transmitter 124 of ball 120 sends the golf ball data to player device 110 via communication path 161. In some embodiments, golf ball data from a golf ball 120 can be received at player device 110 via communication path 160. In such embodiments, transmitter 124 of ball 120 sends the golf ball data to electronic module 142 of golf hole 140 via communication path 162. In turn, transmitter 144 of hole 140 sends the golf ball data to player device 110 via communication path 160. In some embodiments, golf ball data from a golf ball 120 can be received at player device 110 via communication path 152. In such embodiments, transmitter 124 of ball 120 sends the golf ball data to electronic module 142 of golf hole via communication path 162. In turn, transmitter 144 of hole 140 sends the golf ball data to host computer 150 via communication path 164, which in turn sends the golf ball data to the player device 110 via communication path 152.

In embodiments comprising ball launch data, ball launch data can be measured by IMU sensor 126 of ball 120 during and/or after impact with a club head. Ball launch data measured by IMU sensor can comprise, but is not limited to, a spin of the ball 120 after impact with a golf club, a trajectory of the ball 120 after impact with a golf club, a velocity of the ball 120 after impact with a golf club, or a combination thereof. In some embodiments, IMU sensor 126 can capture this data by detecting an impact between the ball 120 and a club face, and capturing spin, trajectory, and/or velocity data during and/or immediately after impact. Ball launch data received for a plurality of balls 120 can be used to calculate, for example, an average ball spin after impact with a golf club, an average ball trajectory after impact with a golf club, an average ball velocity after impact with a golf club, or a combination thereof. Spin after impact with a golf club can be back spin, forward spin, or side spin.

In some embodiments, to capture data during and/or immediately after impact, IMU sensor 126 can capture data one or more times in a time period ranging from 0 milliseconds to 900 milliseconds after impact. In some embodiments, IMU sensor 126 can capture data one or more times in a time period ranging from 0 milliseconds to 800 milliseconds after impact, from 0 milliseconds to 700 milliseconds after impact, from 0 milliseconds to 500 milliseconds after impact, from 100 milliseconds to 900 milliseconds after impact, from 200 milliseconds to 900 milliseconds after impact, from 300 milliseconds to 900 milliseconds after impact, from 500 milliseconds to 900 milliseconds after impact, or from 500 milliseconds to 700 milliseconds after impact. The data capture time(s) for IMU sensor 126 can be appropriately selected based on the sampling rate of the IMU sensor 126. Generally, an impact duration for golf shot is about 500 microseconds with the initial impact occurring at time "zero." IMU sensor 126 can capture data one or more times in any of the time periods discussed above starting at impact (i.e., time "zero").

In embodiments comprising golf ball positional data, ball positional data can be measured by collecting positional data related to the position of the ball 120 relative to the hole 140 by electronics module 142 or by one or more position sensors 180. Ball positional data can comprise, but is not limited to, data indicating a golf ball was made in a golf hole 140, a total distance between the golf hole 140 and one or more golf balls 120, a lateral distance between the golf hole 140 and one or more golf balls 120, a vertical distance between the golf hole 140 and one or more golf balls 120, or a combination thereof. Ball positional data received for a plurality of balls 120 can be used to calculate for example, a number of golf balls made in the golf hole, an average total distance between the golf hole and a plurality of golf balls, an average lateral distance between the golf hole and a plurality golf balls, an average vertical distance between the golf hole and a plurality golf balls, or a combination thereof.

In some embodiments, data indicating a golf ball was made in a golf hole 140 can be measured by electronics module 142 of hole 140 detecting a golf ball 120 has fallen within the hole 140. For example, in some embodiments, electronics module 142 can comprise a radio frequency receiver 146 configured to receive a radio frequency signal from a radio frequency transmitter 124 of ball 120. In such embodiments, electronics module 142 can detect a golf ball 120 has fallen within the hole by sensing the radio frequency transmitter 124 of ball 120. In some embodiments, a radio frequency receiver 146 can be configured to read a radio frequency identification (RFID) signal from the radio frequency transmitter 124 of ball 120. In some embodiments, radio frequency receiver 146 can be an NFC receiver configured to read an NFC signal from an NFC transmitter 124 of ball 120. In some embodiments, radio frequency receiver 146 can be a UWB receiver configured to read an ultra-wideband frequency signal from a UWB transmitter 124 of ball 120. In some embodiments, this data indicating the ball 120 is located in the hole 140 can be used by system 100 to calculate the number of golf balls made in a golf hole. In some embodiments, this data indicating the ball 120 is located in the hole 140 can be used by system 100 to calculate the number of impacts or strokes taken before the ball 120 is successfully placed in the hole 140 (for example, the number of strokes taken between a teeing area and a golf hole at venue 802). In some embodiment, in the context of venue 802 described herein, this data indicating the ball 120 is located in the hole 140 can be used to detect the number of golf balls that have been holed out in a predetermined period of time (such as a day, a month, a year, or a week).

In some embodiments, data indicating a golf ball was made in a golf hole 140 can be measured by position sensor 180 determining that a golf ball 120 is located at the same position as the golf hole 140. For example, if positional data reveals that the distance between the ball 120 and the hole 140 is less than 2.125 inches (i.e., half the diameter of a standard golf hole), system 100 can determine that the ball 120 is located in the hole 140 (i.e., that the golf ball 120 has been made in the hole 140). In some embodiments, this data indicating the ball 120 is located in the hole 140 can be used by system 100 to calculate the number of golf balls made in a golf hole. In some embodiments, this data indicating the ball 120 is located in the hole 140 can be used by system 100 to calculate the number of impacts or strokes taken before the ball 120 is successfully placed in the hole 140 (for example, the number of strokes taken between a teeing area and a golf hole at venue 802). In some embodiment, in the context of venue 802 described herein, this data indicating the ball 120 is located in the hole 140 can be used to detect the number of golf balls that have been holed out in a predetermined period of time (such as a day, a month, a year, or a week).

In some embodiments, data indicating a golf ball was made in a golf hole 140 can comprise data received from ball IMU sensor 126 indicating that the golf ball 120 has fallen into the hole 140. In such embodiments, IMU sensor 126 can be configured to sense when the golf ball 120 falls into a golf hole 140 to indicate that the golf ball 120 has been made in the hole 140. For example, IMU sensor 126 can be configured to recognize a particular pattern of forces associated with ball 120 falling into a golf hole. This data can be transmitted to player device 110 along communication path 161, communication path 160, or communication path 152. Further, this data can be used by system 100 to calculate the number of golf balls made in a golf hole.

Figure 2:
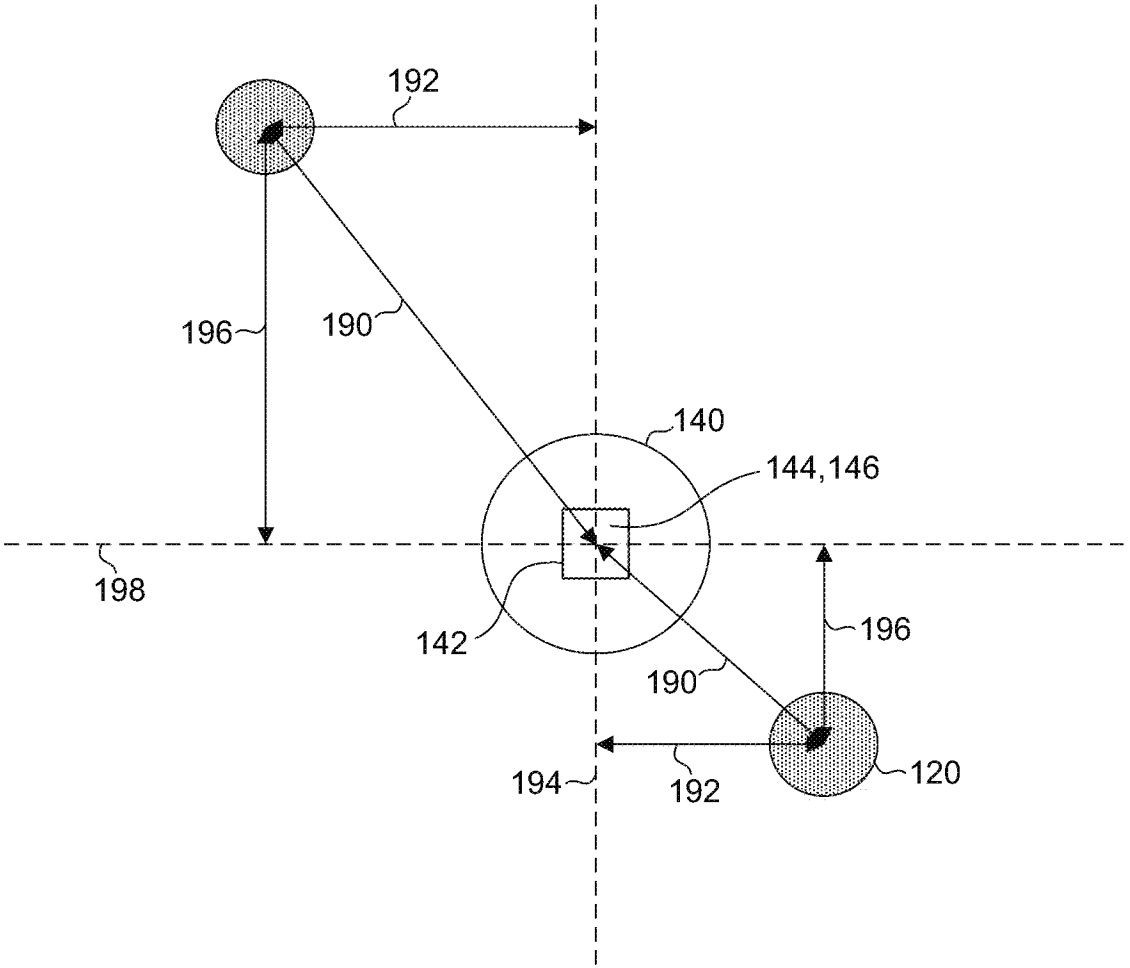
FIG. 2 illustrates golf ball positional data according to some embodiments.

In some embodiments, the positional data can comprise data received from position sensor 180 that comprises data indicating a distance between the ball 120 and the hole 140. As shown for example in FIG. 2, in the event a golf ball 120 is not successfully made within a golf hole 140, the positional data can be used to calculate the total distance 190 between the golf ball 120 and the golf hole 140, a lateral distance 192 between the golf ball 120 and the golf hole 140, and/or a vertical distance 196 between the golf ball 120 and the golf hole 140.

In some embodiments, positional data can comprise data received from a camera, for example an optical camera, a radar camera, or a LiDAR camera. In such embodiments, the position sensor 180 can directly measure total distance 190, lateral distance 192, and/or vertical distance 196.

In some embodiments, positional data can comprise data received from one or more radio-frequency position sensors 181, for example, one or more UWB sensors. A single position sensor 181 can directly measure total distance 190 by communicating with a corresponding radio-frequency position of a ball 120. A plurality of position sensors 181 can measure total distance 190, lateral distance 192, and/or vertical distance 196 by communicating with a corresponding radio-frequency position of a ball 120.

A single UWB position sensor 181 at or within hole 140 can determine the total distance 190 between ball 120 and hole 140 using two way ranging between the UWB position sensor 181 and a corresponding UWB sensor in the ball 120. In such embodiments, two-way UWB communication between the two sensors can sense the distance between the sensors. When the two sensors are within range of each other, the two sensors can start ranging with each other to determine the distance between them by measuring the time it takes a signal to travel between them.

A plurality of position sensors 181 in an array can measure the distance between ball 120 and each sensor 181 and also determine the relative location of ball 120 within the array of sensors 181 using time difference of arrival. In such embodiments, the array of sensors 181 can detect and locate a corresponding UWB sensor in ball 120 to determine the location of ball 120 relative to each sensor 181. In such embodiments, each sensor 181 is synchronized to run on the same clock and the corresponding UWB sensor in ball 120 can transmit signals in regular intervals. The signals transmitted from ball 120 can be received at each of the sensors 181 within the UWB communication range and time-stamped by each sensor 181. The time-stamped data is then integrated to determine the location of ball 120 relative to each sensor 181. In such embodiments, a computer can analyze the positional data from each sensor 181 and the differences in arrival times to each sensor, and use multilateration to calculate the location of ball 120. In turn, the multilateration can be used to calculate total distance 190, lateral distance 192, and/or vertical distance 196.

In some embodiments, the radio-frequency position sensors 181, for example UWB sensors, can have a communication range of from 1 meter to 50 meters, including subranges. For example, the radio-frequency position sensors 181 can have a communication range of from 1 meter to 50 meters, from 1 meter to 40 meters, from 1 meter to 30 meters, from 1 meter to 20 meters, from 1 meter to 10 meters, from 1 meter to 5 meters, or from 1 meter to 2 meters. In some embodiments, the radio-frequency position sensors 181, for example, UWB sensors, can have a communication range of less than or equal to 200 meters.

In some embodiments, the radio-frequency position sensors 181, for example UWB sensors, can have positioning accuracy of 50 centimeters or less. In some embodiments, the radio-frequency position sensors 181, for example UWB sensors, can have positioning accuracy of 20 centimeters or less, 10 centimeters or less, 5 centimeters or less, 2 centimeters or less, or 1 centimeter or less.

Total distance 190 is the distance, in a straight line, from the ball 120 to the hole 140. Lateral distance 192 is the distance, in a straight line, from the ball 120 to a shot line axis 194 bisecting a center of the hole 140. Vertical distance 196 is the distance, in a straight line, from the ball 120 to an orthogonal axis 198 bisecting the center of the hole 140 and orthogonal to the shot line axis 194. In some embodiments, for purposes of determining the shot line axis 194, the shot line axis 194 can be an axis extending, in a straight line, from the player device 110 to the hole 140. In some embodiments, positional data used to determine the shot line axis 194 can be received from transmitter 144 via communication path 160. For purposes of calculating lateral distance 192, the distance is measured along a line parallel to orthogonal axis 198. For purposes of calculating vertical distance 196, the distance is measured along a line parallel to shot line axis 194.

In some embodiments, shot line axis 194 can be a pre-assigned axis in system 100. For example, if system 100 comprises a designated spot from which golf balls 120 are hit towards hole 140 (for example a teeing area 810), shot line axis 194 can be set as a particular axis extending from the hole 140 to the designated spot.

In some embodiments, shot line axis 194 can be determined by data received from a radio-frequency sensor array (e.g., a UWB sensor array) that determines the location of a player device 110 relative to hole 140. In such embodiments, the positional data received from a plurality of the UWB sensors can be used to determine the location of player device 110 relative to hole 140 using multilateration, and therefore determine the position of shot line axis 194.

In some embodiments, the positional data can comprise data received at a UWB receiver of golf hole 140 from UWB transmitter of ball 120 indicating total distance 190 between the golf hole 140 and the golf ball 120. In such embodiments, the positional data can be transmitted from golf hole 140 to player device 110 via communication path 160 or from golf hole 140 to host computer 150 via communication path 164.

In some embodiments, the positional data received from position sensor 180 can comprise data received from a radio-frequency sensor array (e.g., UWB sensor array) that determines the location of a golf ball 120 relative to hole 140. In such embodiments, the positional data received from a plurality of radio-frequency sensors 181 can be used to calculate the location of the golf ball 120 relative to hole 140 using multilateration. In such embodiments, the positional data received from the position sensor 180 can comprise total distance 190, lateral distance 192, vertical distance 196, or a combination thereof.

Golf ball positional data comprises, but is not limited to, the positional data indicating a distance between the ball 120 and the hole 140, positional data indicating a distance between the hole 140 and the player device 110, positional data indicating a distance between the ball 120 and the player device 110, or a combination thereof. As discussed above, this positional data can be used to calculate ball positional data for one or more balls 120. Golf ball positional data that can be received at player device 110 or computer 150 can alternatively or additionally comprise data transmitted from hole transmitter 144 indicating a golf ball 120 has been made in a golf hole or data indicating a golf ball 120 has been made in a golf hole transmitted from the golf ball 120 to the receiver 146 of golf hole 140 for subsequent transmission to player device 110 or computer 150.

In all embodiments comprising positional data, the positional data can be confirmed after determining a ball 120 has been at rest for more than a predetermined amount of time. System 100 can determine a ball 120 is at rest if there is no significant change in the positional data for more than the predetermined amount of time. The predetermined amount of time can be, for example, two seconds, three seconds, or four seconds. Change in positional data after the predetermined time can be disregarded by system 100.

In some embodiments, system 100 can be configured to match golf ball data received from golf ball 120 with positional data measured by a position sensor 180 by tracking time stamps for when a ball is contacted by a club face and when a ball arrives with the field of view for the position sensor 180. In some embodiments, a time stamp for when a ball 120 is contacted by a club face can be captured by an IMU sensor 126 configured to detect an impact between the ball 120 and a club face. In such embodiments, the time stamp for each ball 120 can be transmitted to player device 110 or host computer 150 via communication path 160, 161, or 164. In some embodiments, a time stamp for when a ball 120 is contacted by a club face can be captured by an IMU sensor of an electronic assembly 404 in a club head configured to detect an impact between the ball 120 and a club face. In such embodiments, the time stamp for each ball 120 can be transmitted by a transmitter of electronic assembly via communication path 163. A time stamp for when a ball arrives with the field of view for a position sensor 180 can be captured by position sensor 180 can transmitted to player device 110 or host computer 150 via communication path 182 or communication path 184.

System 100 can be configured to match a golf ball data to positional data when the time stamp for an impact between a ball and club face, and the time stamp for when a ball arrives with the field of view for a position sensor 180, is less than a predetermined amount of time. The predetermined amount of time can be, for example, two seconds, three seconds, or four seconds. In this manner, system 100 can correctly integrate golf ball positional data with other data for a golf shot.

Figure 4A:
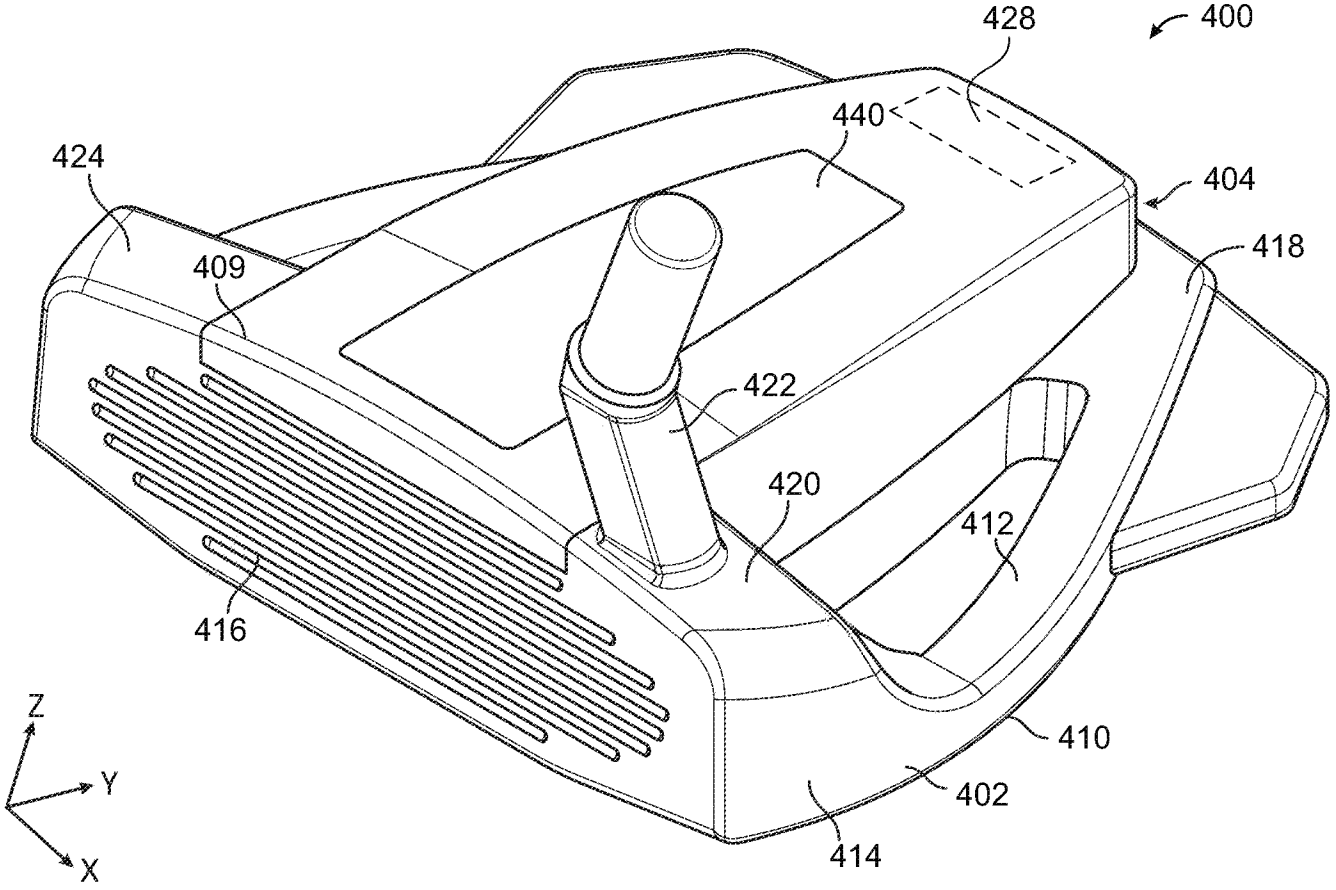
FIGS. 4A-4C illustrate a club head according to some embodiments.
Figure 4B:
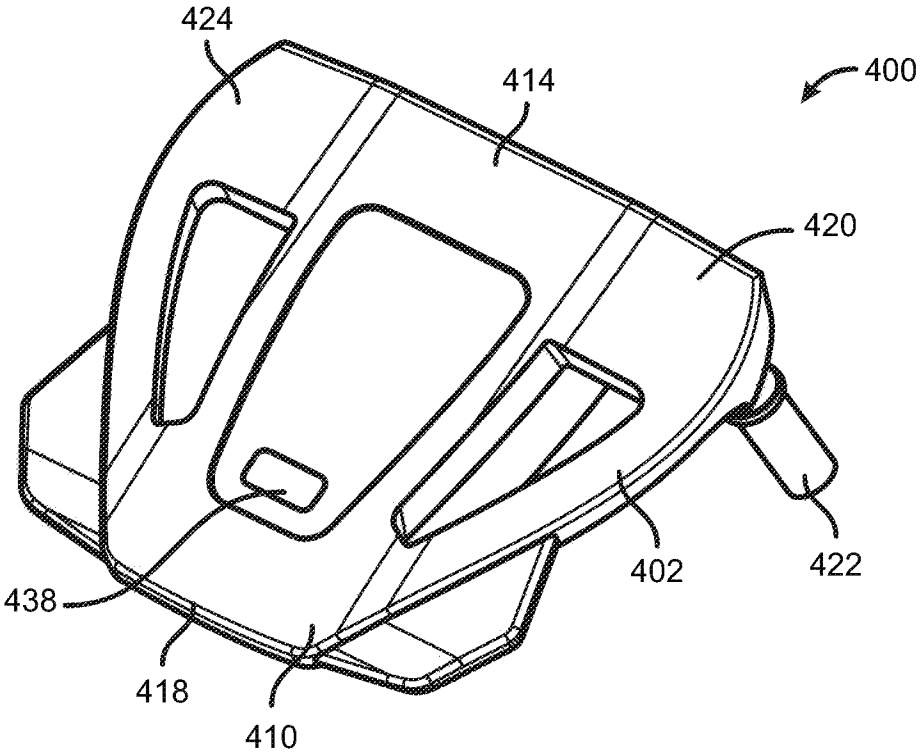
Figure 4C:
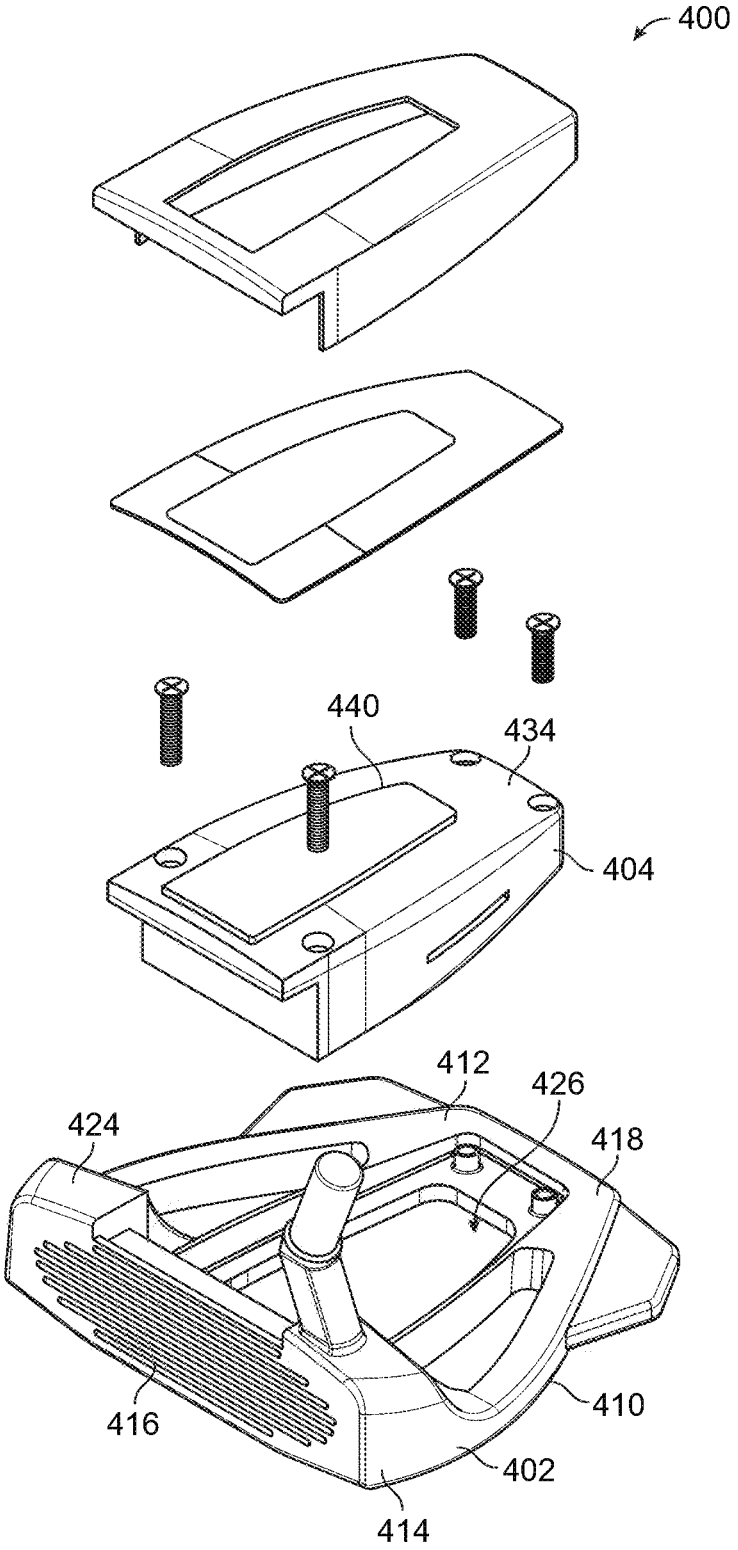

FIGS. 4A-4C illustrate a golf club head 400 for golf club 118 according to some embodiments. Although the descriptions and drawings presented herein are mainly associated with putters, any of the technology disclosed herein can analogously be implemented in any other type of golf club, such as a driver, fairway wood, hybrid, rescue, iron, wedge, or other golf club type. Any of the embodiments described herein can include any of the features described in U.S. Pat. Nos. 11,731,014, 11,701,555, U.S. Provisional Patent Application No. 63/305,777, or U.S. patent application Ser. Nos. 17/878,734, 18/105,194, which are all incorporated by reference in their entirety.

As shown, club head 400 comprises a body 402 and an electronic assembly 404 integrated within the body 402. The body 402 comprises a sole portion 410 configured to rest on a ground when the club head 400 is at a normal address position, a top portion 412 opposite to the sole portion 410, a forward portion 414 comprising a striking face 416, a rearward portion 418 opposite to the forward portion 414, a heel portion 420 comprising a hosel 422 configured to receive a golf club shaft, and a toe portion 424 opposite to the heel portion 420. In some embodiments, a middle part of the body 402 can comprise a cavity 426 configured to receive the electronic assembly 404.

When electronic assembly 404 is inserted into the cavity 426, a top portion 409 of the electronic assembly 404 can extend overtop an upper portion of the body 402 proximate the striking face 416. In some embodiments, the top portion 409 of the electronic assembly 404 can form or define an uppermost portion of the club head 400 (excluding the hosel 422) and/or the uppermost portion of the striking face 416.

In some embodiments, the electronic assembly 404 can comprise a housing 434 (which can also be referred to as a "case") and an electronic display 440 disposed on top of the housing 434. In some embodiments, electronic display 440 can be display screen 112 in system 100. In some embodiments, electronic display 440 can be a second display screen within system 100 configured to display a plurality of different alignment features (for example, the alignment features 520 shown in FIGS. 5A-5O).

In some embodiments, the housing 434 can comprise a plastic material. The shape and size of the cavity 426 can match those of the housing 434 so that the housing 434 can extend into and snug fit within the cavity 426. The electronic display 440, which is in electronic communication with the controller of the electronic assembly 404, can be visible to a player when the club head 400 is in the address position.

The electronic assembly 404 can include various electronic components forming an electronic circuit and enclosed within the housing 434, such as a controller, one or more memory units, one or more sensors, a communication unit, one or more batteries, storage devices, connecting wires, input/output (I/O) ports, etc. At least parts of the electronic circuit can be integrated within a printed circuit board (PCB). Housing 434 can also house a battery for powering electronic assembly 404 and electronic display 440.

The electronic circuit of electronic assembly 404 can be configured as a computing system similar to computer system 1110 depicted in FIG. 11, which is described more fully below. For example, a controller of the electronic assembly 404 can be one or more processors 1114, the memory units can be memory subsystem 1126, the one or more sensors can be an input device 1122, the electronic display 440 can be an output device 1120, and a communication unit can be a transceiver 1140 or network interface subsystem 1116.

The assembly 404 can be configured to manage and control various aspects of the operation of the electronic circuit, including battery management, on/off status of the electronic display 440, control of power levels, sensor measurement, analysis of the measured sensor data, displaying alignment features or other information on the electronic display 440, communication with external computing devices, and the like. For example, when the golf club head is oriented in an upside-down position (such as a storage position in a golf bag), an IMU sensor may detect that the golf club head is not in use and power down the electronic display or components to conserve battery life. Conversely, when the IMU is rotated in an upright user position, the IMU may detect the upright orientation and power on the assembly 404 and/or any associated electronic components described herein.

In some examples, the sensors of electronic assembly 404 can comprise at least one inertial measurement unit (IMU) sensor. In some examples, the IMU can be a 9-axis sensor including one or more accelerometers, gyroscopes, and magnetometers that measure 3D orientation, 3D velocity, 3D gravitational forces, and/or other properties of the club head 400. In some embodiments, the sensors can include one or more proximity sensor, gesture sensor, motion sensor, impact sensor, pressure/barometer sensor, sound sensor (e.g., microphone, etc.), humidity sensor, light or optical sensor (e.g., camera, etc.), color sensor, or the like. The sensors can be electronically coupled to the controller, battery, and/or other electronic components. The sensors can be enclosed within the housing 434 or located outside the housing 434. For example, the sensors can be positioned at various locations around the club head 400 as desired, and can be attached to the body or other club head components.

In some embodiments, electronic assembly 404 can be configured to communicate with mobile computing device 116 via a wired or a wireless communication protocol. In some embodiments, electronic assembly 404 can be configured to receive data from the mobile computing device 116.

In some embodiments, the electronic assembly 404 can be configured to store one or more images in a memory (for example, memory subsystem 1126). The one or more images, when displayed on the electronic display 440, can include an alignment feature, for example any of the alignment features 520 shown in FIGS. 5A-5O. For example, the controller the electronic assembly 404 can be configured to select an alignment feature from a plurality of alignment features and display the selected alignment feature on the electronic display 440. In some examples, the mobile computing device 116 can control what alignment feature is displayed on the electronic display 440. For example, the controller can be configured to receive data from the mobile computing device 116 through a communication unit (for example, a transceiver 1140 or network interface subsystem 1116), and display an alignment feature on the electronic display 440 based on the data received from the mobile computing device 116.

In some embodiments, the electronic display 440 can be fixedly attached to the body 402. In some embodiments, the electronic display 440 can be removably attached to the body 402. The electronic display 440 can comprise any of various display types. For example, the electronic display 440 can comprise an emissive display where each pixel in the display screen is an emitter that outputs light when electric current is applied. Example emissive displays include liquid crystal display (LCD), thin-film-transistor (TFT) LCD, light emitting diodes (LED), organic LED (OLED), active-matrix LED (AMOLED), etc. In some embodiments, the electronic display 440 can comprise a reflective display. In some embodiments, the electronic display 440 can operate in a reflective LCD mode, e.g., by installing a mirror behind the LCD screen, such that ambient light passes through the LCD screen from the front side can be reflected by the mirror back to a viewer. In some embodiments, the reflective display can be a memory-in-pixel (MiP) display based on Low Temperature Poly Silicon (LTPS). In some embodiments, the reflective display can be an e-ink or e-paper display based on microencapsulated electrophoretic display technologies. In some embodiments, electronic display 440 can comprise a touch-sensitive screen.

In some embodiments, club head 400 can have more than one electronic display, such as being located at two different parts of the club head separate from each other, such as one at the toe side and one at the heel side, front and back sides, etc.

The electronic display 440 can be configured (e.g., via the controller) to display at least one alignment feature to assist a player to aim, such as based on position and/or motion data measured by one or more sensors. For example, the player can test various alignment features and select a preferred alignment feature.

In some embodiments, information other than an alignment feature can be displayed on the electronic display 440. For example, a date/time clock, weather information (e.g., temperature, humidity, wind speed, etc.), an indicator of a sport teams, or any other information can be displayed. In some examples, the electronic display can provide an interface for customized display, e.g., showing a logo, scanning/receiving a broadcast, etc. As another example, in some embodiments, data integrated within system 100 can be displayed on the electronic display 440.

Figure 5A:
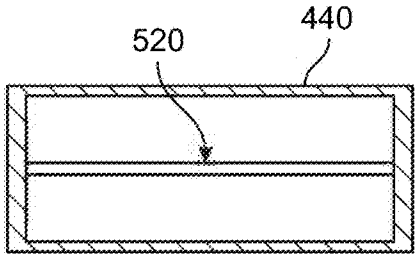
FIGS. 5A-5O illustrate various example alignment features according to some embodiments.
Figure 5B:
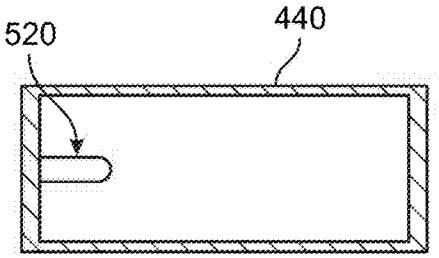
Figure 5C:
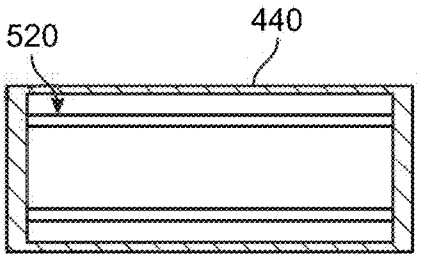
Figure 5D:
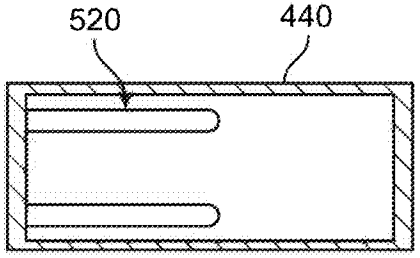
Figure 5E:
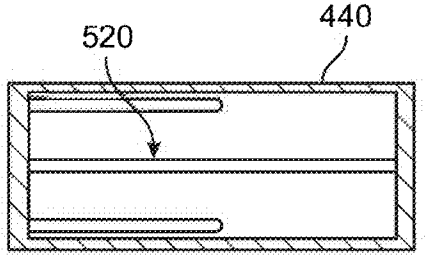
Figure 5F:
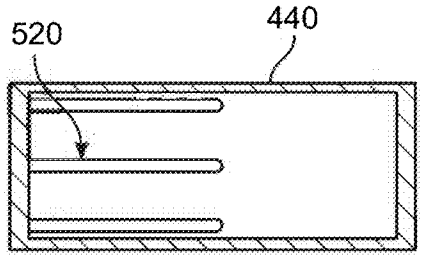
Figure 5G:
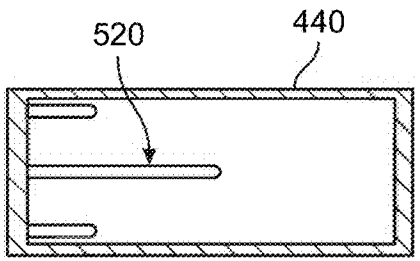
Figure 5H:
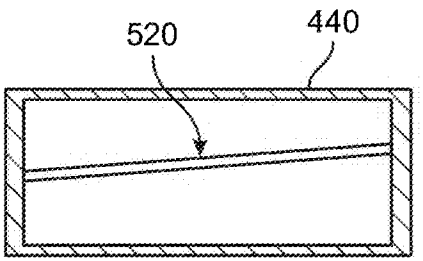
Figure 5I:
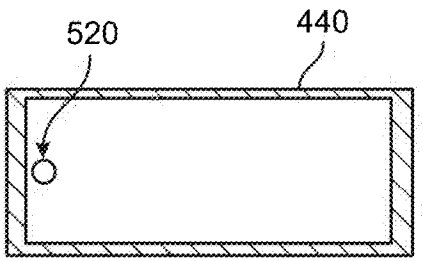
Figure 5L:
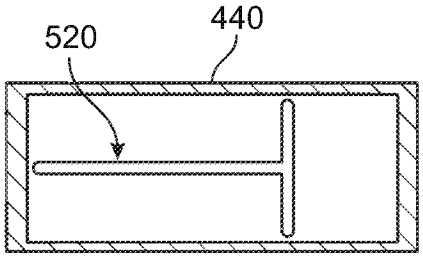
Figure 5K:
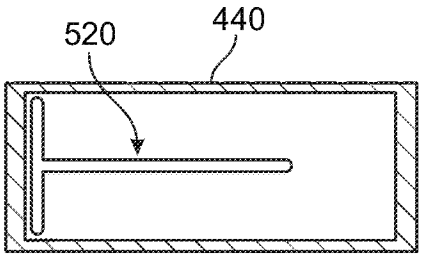
Figure 5J:
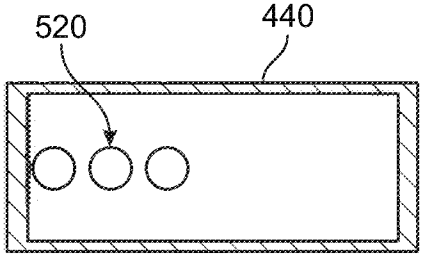
Figure 5O:
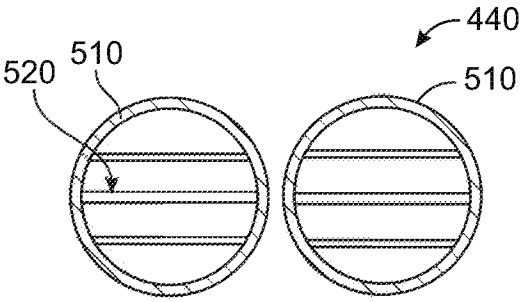
Figure 5N:
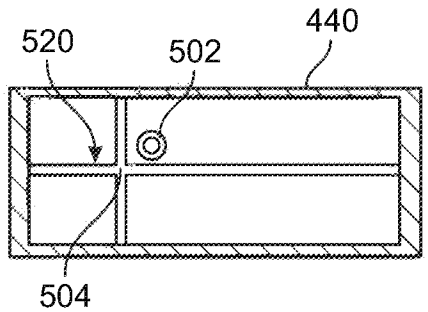

FIGS. 5A-5O show various example alignment features 520 that can be displayed on the electronic display 440 of a club head 400. For simplicity, the electronic display 440 in FIGS. 5A-5N is shown to have a rectangular shape. Nevertheless, it is to be understood that the electronic display 440 can have a different shape. In FIGS. 5A-5N, the left part of the rectangle represents the front part of the electronic display 440 and the right part of the rectangle represents the rear part of the electronic display 440. The front part of the electronic display 440 is closer to the striking face of the club head than the rear part of the electronic display 440.

In some embodiments, the alignment feature 520 can include one or more sight lines extending from the front part of the electronic display toward the rear part of the electronic display (see, e.g., FIGS. 5A-5H). The sight lines can be configured to have various lengths, widths, and/or contrasting colors. The sight lines can also be configured to have various line styles (e.g., solid, dashed, dotted, dash-dotted, etc.). Such sight lines can indicate a direction for aiming/putting.

In some embodiments, the alignment feature 520 can include a single straight sight line (e.g., FIGS. 5A, 5B, 5H). The single sight line can extend a full length of the electronic display or only a partial length of the electronic display. In some embodiments, the alignment feature 520 can include a plurality of sight lines, such as two parallel sight lines (e.g., FIGS. 5C and 5D), triple sight lines (e.g., FIGS. 5E-5G), or more than three sight lines.

Figure 5M:
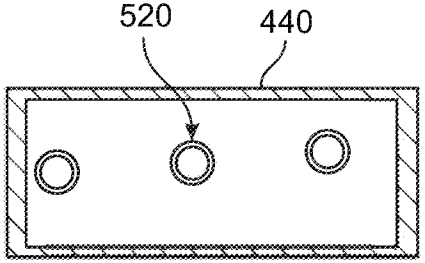

In some embodiments, the alignment feature 520 can be represented by one or more predefined shapes such as dots, geometric patterns, letters, numbers, symbols, arrows, dashed lines, solid lines, quadrilaterals, hexagons, heptagons, octagons, nonagons, decagons, circles, ovals, squares, parallelogram, rectangles, triangles, or other known polygons. In some embodiments, these shapes can be aligned in a straight line or slightly skewed based on user preference or even based on eye dominance. In some embodiments, the alignment feature 520 may not align directly toward an intended put line (an intended put line would be normal to the face) but rather may be skewed by a skew angle between 0 degrees and 20 degrees. A skew angle is defined as the angle between the alignment feature alignment direction (also described herein as sight line) and an imaginary line perpendicular to the strike face. As described herein, an imaginary line connecting the one or more predefined shapes is also referred to as a sight line. For example, FIG. 5I shows a single circle, whereas FIGS. 5J and 5M show three circles arranged in a sight line extending from the front part of the electronic display toward the rear part of the electronic display. The predefined shapes (e.g., circles) can have various sizes, filling patterns, contrasting colors, or the like. Similarly, the sight line connecting the predefined shapes can be perpendicular to the striking face of the club head (e.g., FIG. 5J) or form an oblique angle relative to the striking face of the club head (e.g., FIG. 5M). Additionally, the sight line connecting the predefined shapes can be straight or curved. The distance between two adjacent redefined shapes can also vary (e.g., the distance between two adjacent circles in FIG. 5J is closer than that in FIG. 5M).

In some embodiments, the alignment feature 520 can have a T-shaped display pattern (e.g., FIGS. 5K and 5L) or a cross-shaped display pattern (e.g., FIG. 5N). In some embodiments, an indicator 502 (e.g., a dot/circle/bubble/line or other shaped object) can appear at an intersection 504 between the first and second lines of a T-shaped pattern. When the indicator 502 overlaps with the intersection 504, it can indicate that the club head is in a neutral or un-tilted state. Displacement of the indicator 502 from the intersection 504 can indicate the club head is in a tilted state. This indicator feature can function similar to a bubble level in carpentry, though using sensors and electronics rather than a gas bubble in a liquid.

In some embodiments, the electronic display 440 can comprise two or more display windows of a predefined shape (e.g., circle, square, etc.), and the alignment feature 520 (e.g., sight lines) can extend through the display windows. For example, FIG. 5O shows two circular display windows 510 that are spaced apart from one another, and three sight lines extend through both windows 510.

In some embodiments, electronic assembly 404 can be configured to receive one or more images from a user operable electronic device, for example mobile computing device 116. In some embodiments, electronic assembly 404 can be configured to store the one or more images in a memory. The one or more images when displayed on the electronic display 440 can comprise an alignment feature.

In some embodiments, electronic assembly 404 can be configured to wirelessly receive data from a user operable electronic device, for example mobile computing device 116, and display an alignment feature on the electronic display 440 based on the data received from the user operable electronic device. For example, through a player interface of an application running on the mobile computing device 116, a player can select an alignment feature from a plurality of predefined alignment features, and then transmit such selected alignment feature to the controller of the club head 400. The club head can then use that selected alignment feature for display. In some embodiments, the player can create, edit, delete, and/or save an alignment feature through a user interface of the mobile computing device 116.

In some embodiments, instead of using a touch screen, club head 400 can comprise a switch 438 configured to allow a player to select an alignment feature for display. For example, the plurality of predefined alignment features can have a predefined sequence. By pushing the switch 438 sequentially, the controller can loop through the sequence, thereby allowing the player to select one of the alignment feature for display.

In some embodiments, golf club head 400 can comprise an identifier 428 that uniquely identifies club head 400 to system 100. In some embodiments, identifier 428 can be an electronic identifier, such as a radio frequency identification (RFID) signal, an NFC signal, a Wi-Fi signal, an ultra-wideband (UWB) signal, or a BLUETOOTH® signal. In such embodiments, electronic assembly 404 can comprise the electronic identifier 428 in the form of an RFID chip, an NFC chip, a Wi-Fi chip, ultra-wideband (UWB) chip, or a BLUETOOTH® beacon. In some embodiments, identifier 428 can be an optically identifiable image, for example, a barcode, a quick response (QR) code, or a unique graphical image.

As discussed herein, data received at one or more player devices 110, computer 150, or both can be integrated and displayed for a player 102. In some embodiments, golf club data can be integrated with golf ball data and displayed for the player. In some embodiments, golf club data can be integrated with golf ball positional data and displayed for the player. In some embodiments, the golf club data can be integrated with the golf ball data and the golf ball positional data, and display for the player.

In some embodiments, the IMU sensor 126 of a golf ball 120 can be configured to sense when the golf ball 120 falls into a golf hole, and the integrated data can comprise a number of golf balls made. In such embodiments, the data indicating the golf ball 120 fell into the golf hole can be communicated via communication path 160, communication path 161, or communication path 164. By sensing, via the IMU sensors 126 of multiple golf balls 120, that multiple balls have been made in a golf hole, system 100 can integrate the number of balls made with other data, for example golf club data.

In embodiments that integrate the number of balls made with golf club data, system 100 can display integrated data comprising the number of balls made with a certain club type, a certain alignment feature type, or both. This integrated data can be used by player 102 to assess which club type is preferable, which alignment feature is preferable, or both. As a non-limiting example, FIG. 7 shows a display screen 700 comprising golf club data 702 and golf ball data 703 comprising a number of balls made with various club types and alignment feature types.

In some embodiments, the IMU sensor 126 of a golf ball 120 can be configured to measure golf ball launch data (for example, one of more of: a spin of the ball after impact with a golf club, a trajectory of the ball after impact with a golf club, or a velocity of the ball after impact with a golf club) by measuring ball launch data immediately after an impact between the golf ball and a club face. In such embodiments, the golf ball launch data can be communicated via communication path 160, communication path 161, or communication path 164. By sensing, via the IMU sensors 126 of multiple golf balls 120, ball launch data for multiple balls 120, system 100 can integrate the ball launch data for multiple balls with other data, for example club data. This integrated data can be used by player 102 to assess which club type is preferable, which alignment feature is preferable, or both. For example, player 102 can assess which club type and/or alignment feature type provides a preferable trajectory. Integrated ball launch data can be displayed as an average for multiple balls 120 struck with a particular club, for example an average ball spin after impact with a golf club, an average ball trajectory after impact with a golf club, or an average ball velocity after impact with a golf club. As a non-limiting example, FIG. 7 shows a display screen 700 comprising golf club data 702 and golf ball data 703 comprising ball launch data 706 comprising an average spin rate and an average trajectory.

System 100 can be configured to integrate golf ball data, golf ball positional data, and golf club data in a variety of combinations.

In some embodiments, the integrated data can comprise golf ball positional data (for example, one or more of: a number of golf balls made in the golf hole, an average total distance between the golf hole and one or more golf balls, an average lateral distance between the golf hole and one or more golf balls, or an average vertical distance between the golf hole and one or more golf balls).

In some embodiments, the integrated data can comprise ball launch data (for example, a spin of a plurality of balls after impact with a golf club, a trajectory of a plurality of balls after impact with a golf club, or a velocity of a plurality balls after impact with a golf club measured via IMU sensors 126).

In some embodiments, the integrated data can comprise the golf ball positional data and the golf ball launch data. In some embodiments, the integrated data can comprise the golf ball positional data, the golf ball launch data, and golf club data.

In some embodiments, the integrated data can comprise the golf ball positional data and golf club data. In some embodiments, the integrated data can comprise the golf ball launch data and golf club data.

In some embodiments, the golf club data can comprise one or more of: a club type or an alignment feature type.

In some embodiments, the integrated data can comprise golf ball positional data and golf club data comprising a club type or an alignment feature type. In such embodiments, the integrated data can be used by player 102 to assess which club type is preferable, which alignment feature is preferable, or both. For example, a player 102 can assess which club type and/or which alignment feature leads to that player making the most number of shots in a golf hole. As another example, a player 102 can assess which club type and/or which alignment feature leads to minimizing the average total distance 190 between balls 120 and a hole 140. The integrated data can also be used be the player to assess which club type and/or which alignment feature minimizes the lateral or vertical distance between balls 120 and a hole 140. As a non-limiting example, FIG. 7 shows a display screen 700 comprising golf club data 702 and golf ball data 703 comprising golf ball positional data 704 comprising a number of balls made and an average total distance 190 of missed shots with various club types and alignment feature types.

In some embodiments, the integrated data can comprise golf ball launch data and golf club data comprising a club type or an alignment feature type. In such embodiments, the integrated data can be used by player 102 to assess which club type is preferable, which alignment feature is preferable, or both. For example, a player 102 can assess which club type and/or which alignment feature leads to that player hitting shots with the straightest trajectory. As another example, a player 102 can assess which club type and/or which alignment feature leads minimizing the amount of side spin after impact with a club face. As a non-limiting example, FIG. 7 shows a display screen 700 comprising golf club data 702 and golf ball data 703 comprising golf ball launch data 706 comprising an average spin rate and an average trajectory with various club types and alignment feature types.

In some embodiments, the integrated data can comprise the golf ball positional data, golf ball launch data, and club data comprising a club type or an alignment feature type. In such embodiments, the integrated data can be used by player 102 to assess which club type and/or which alignment feature is preferable from multiple perspectives. For example, a player could assess which club type provides a preferable trajectory while also minimizing the lateral or vertical distance between balls 120 and a hole 140. Any combination of the golf ball positional data and the golf ball launch data combined with the golf club data can be used by the player to assess which club type and/or which alignment feature is preferable. As a non-limiting example, FIG. 7 shows a display screen 700 comprising golf club data 702 and golf ball data 703 comprising golf ball positional data 704 and golf ball launch data 706 for various club types and alignment feature types.

In some embodiments, golf club 118 can comprise a club sensor (for example, one or more IMU sensors located in electronic assembly 404 of club head 400). In such embodiments, the IMU sensor(s) can be configured to measure swing data for a player's golf swing. And the swing data measured by the IMU sensor(s) can be communicated to player device 110 via communication path 163 by a transmitter located in electronic assembly 404. Exemplary swing data comprises, but is not limited to, a golf club lie angle at address, a golf club loft angle at address, a golf club face angle at address, a golf club lie angle at impact with a golf ball, a golf club loft angle at impact with a golf ball, a golf club face angle at impact with a golf ball, a golf club swing path, a swing tempo, a back swing duration, a swing transition rate, a swing width, or a club head rotation, or a combination thereof.

In embodiments comprising swing data communicated to player device 110, the integrated data can comprise the swing data in combination with one or more of the golf club data, the golf ball positional data, or the golf ball launch data. In some embodiments, the integrated data can comprise the swing data in combination with the golf club data. In some embodiments, the integrated data can comprise the swing data in combination with the golf ball positional data. In some embodiments, the integrated data can comprise the swing data in combination with the golf ball launch data. In some embodiments, the integrated data can comprise the swing data in combination with the golf club data and the golf ball positional data. In some embodiments, the integrated data can comprise the swing data in combination with the golf club data and the golf ball launch data. In some embodiments, the integrated data can comprise the swing data in combination with the golf club data, the golf ball positional data, and the golf ball launch data. As a non-limiting example, FIG. 7 shows a display screen 700 comprising golf club data 702, golf ball data 703, and swing data 708 comprising an average golf club lie angle at impact with a golf ball and an average golf club loft angle at impact with a golf ball.

In embodiments comprising launch monitor 170, a computer of system 100 can be configured to integrate golf ball shot characteristics and one of more of: the club data, the golf ball data, the golf ball positional data. In some embodiments, the computer of system 100 can be configured to integrate all of: the club data, the golf ball data, the golf ball positional data, and the golf ball shot characteristics.

In embodiments comprising motion sensor 172, a computer of system 100 can be configured to integrate motion-based golf swing characteristics and one of more of: the club data, the golf ball data, the golf ball positional data. In some embodiments, the computer of system 100 can be configured to integrate all of: the club data, the golf ball data, the golf ball positional data, and the motion-based golf swing characteristics.

Figure 6:
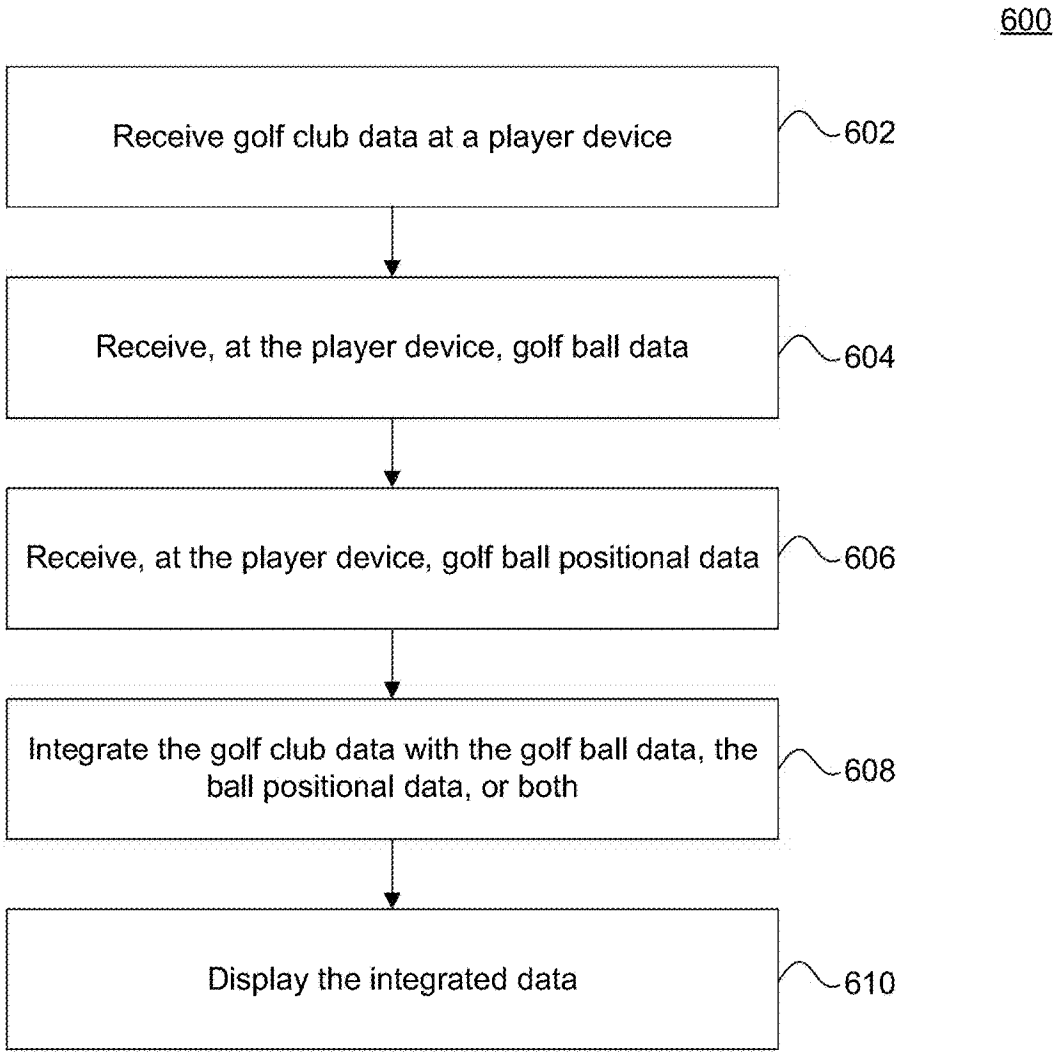
FIG. 6 is a flow chart illustrating a method of integrating data according to some embodiments.

FIG. 6 illustrates a method 600 of integrating data within system 100 according to some embodiments. The following discussion describes an exemplary operational control flow for integrating data. The operational control flow can be executed by one or more computing devices, processors, controllers, systems, or other electrical, mechanical, and/or electro-mechanical devices executing firmware, software applications, routines, instructions, and/or the like within system 100, such computer 114 or host computer 150.

In step 602, golf club data can be received at a player device 110 comprising a display screen 112. In some embodiments, receiving golf club data in step 602 can comprise a player manually inputting golf club data via one or more inputs of player device 110 (for example, user interface input devices 1122). In some embodiments, receiving golf club data in step 602 can additionally or alternatively comprise computer 114 automatically inputting or downloading golf club data at player device 110. For example, a selected alignment feature type for club head 400 can be automatically received from a memory (for example, storage subsystem 1124) of player device 110. In such embodiments, when player switches from a first alignment feature type to a second alignment feature type, computer 114 can automatically input a change from the first alignment feature to the second alignment feature.

In step 604, golf ball data from a golf ball 120 can be received at the player device 110. The golf ball data can comprise golf ball positional data, golf ball launch data, or both. In some embodiments, in step 604, golf ball data from a golf ball 120 can be wirelessly received at the player device 110 from a golf ball transmitter 124 located within a golf ball 120. In some embodiments, the golf ball data can be received via communication path 161. In some embodiments, golf ball data can be received via communication path 160. In such embodiments, step 604 can comprise transmitting golf ball data, via transmitter 124 of ball 120, to an electronic module 142 of a golf hole 140 via communication path 162. In turn, transmitter 144 of hole 140 sends the golf ball data to player device 110 via communication path 160. In some embodiments, golf ball data can be received via communication path 152. In such embodiments, step 604 can comprise transmitting golf ball data, via transmitter 124 of ball 120, to an electronic module 142 of a golf hole 140 via communication path 162. In turn, transmitter 144 of hole 140 sends the golf ball data to host computer 150 via communication path 164, which in turn sends the golf ball data to the player device 110 via communication path 152.

In step 606, golf ball positional data from a position sensor 180 can be received at the player device 110. Golf ball positional data can comprise positional data as described herein. In some embodiments, the golf ball positional data can be received a player device 110 via communication path 182. In some embodiments, golf ball positional data can be received at a player device 110 via communication path 152. In such embodiments, step 606 can comprise transmitting golf ball positional data to host computer 150 via communication path 184, which in turn sends the golf ball positional data to the player device 110 via communication path 152.

In step 608, the golf club data can be integrated with the golf ball data, the golf ball positional data, or both. In some embodiments, step 608 can also comprise integrating golf swing data measured by a club sensor (for example, one or more IMU sensors located in electronic assembly 404 of club head 400) and communicated to a player device 110 via communication path 163 by a transmitter of electronic assembly 404.

In some embodiments, step 608 can also comprising integrating golf ball shot characteristics received from launch monitor 170 via a communication path 174 and/or motion-based golf swing characteristics received from motion sensor 172 via a communication path 175. In some embodiments, step 608 can be performed in whole or in part by computer 114 of a player device 110. In some embodiments, step 608 can be performed in whole or in part by host computer 150. In such embodiments, the host computer can transmit the integrated data to computer 114 of the player device 110 via communication path 152.

In step 610, the integrated data is displayed on a display screen. In some embodiments, in step 610, the integrated data can be displayed on the display screen 112 of the player device 110. In some embodiments, in step 610, the integrated data can be displayed on a display of host computer 150.

FIG. 7 shows a display screen 700 displaying integrated data according to some embodiments. Display screen 700 comprises golf club data 702, golf ball data 703, and golf swing data 708. In some embodiments, the golf club data 702, golf ball data 703, and golf swing data 708 can be displayed in a player's statistics screen 701.

Golf club data 702 can comprises data indicating the golf club used by a player 102 for one or more golf shots. In some embodiments, golf club data 702 can comprise the club type used by the player 102 for one or more golf shots. For example, club type "Pa" can symbolize a first putter type used by the player 102 (for example, a TAYLORMADE® Spider putter), club type "Pb" can symbolize a second putter type used by the player 102 (for example, a TAYLORMADE® TP Hydro Blast putter), club type "Pc" can symbolize a third putter type used by the player 102, and club type "Pd" can symbolize a fourth putter type used by the player 102. Further, club type "Wa" can symbolize a first wedge type used by the player 102 (for example, a TAYLORMADE® MYMG3 wedge) and club type "Wb" can symbolize a second wedge type used by the player 102 (for example, a TAYLORMADE® MyHi-Toe 3 wedge).

In some embodiments, golf club data 702 can comprise the alignment feature used by the player 102 for one or more golf shots. For example, as shown in FIG. 7, the player 102 hit various golf balls 120 with club type "Pa" having the alignment feature of FIG. 5A and the alignment feature of FIG. 5C. In some embodiments, club type "Pa" having the different alignment features can be different versions of the same club type. In other embodiments, club type "Pa" having the different alignment features can be putter type Pa comprising club head 400 with a display 440 configured to display a plurality of different alignment features including the alignment features of FIGS. 5A and 5C. Display screen 700 also shows the player 102 hit multiple golf shots with clubs having the alignment feature of FIG. 5K and the alignment feature of FIG. 5M. In some embodiments, the club data 702 can comprise the number of golf balls 120 hit for each golf club.

In some embodiments, the golf ball data 703 can comprise golf ball positional data 704. In some embodiments, as shown in FIG. 7, golf ball positional data 704 displayed can comprise an average total distance 190 between golf balls 120 hit and a golf hole 140, and a number of the golf balls 120 that were made in the golf hole 140. For example, display screen 700 shows the player 102 hit 50 golf balls with club type "Pa" having the alignment feature of FIG. 5A. Of those 50 balls, the player 102 made 10 of them in the hole 140 and the average total distance 190 for the 50 balls was 1.5 feet. As another example, display screen 700 shows the player 102 hit 213 golf balls with club type "Pb" having the alignment feature of FIG. 5K. Of those 213 balls, the player 102 made 103 of them in the hole 140 and the average total distance 190 for the 213 balls was 1 foot.

In some embodiments, the golf ball data 703 can comprise golf ball launch data 706. In some embodiments, as shown in FIG. 7, golf ball launch data 706 displayed can comprise an average spin of balls 120 after impact with a club head and an average trajectory of balls 120 after impact with a club head. For illustration purposes, the average spin is shown in FIG. 7 as "1" (meaning low spin), "2" (meaning moderate spin), and "3" (meaning high spin). However, an average spin can be reported in various ways, for example in an average rotation per minute (rpm). The average trajectories shown in FIG. 7 are average angles of trajectory after impact with a club head, with 0° being parallel to the ground. As an example, display screen 700 shows the player 102 hit 213 golf balls with club type "Pa" having the alignment feature of FIG. 5A. The average spin for those 213 balls was "2" and the average trajectory of those 213 balls was 1°.

In some embodiments, the golf swing data 708 displayed can comprise one or more of golf club lie angle data at impact with a golf ball, golf club loft angle data at impact with a golf ball, or golf club face angle data at impact with a golf ball. In some embodiments, the golf swing data 708 displayed can comprise one or more of an average golf club lie angle at impact with a golf ball, an average golf club loft angle at impact with a golf ball, or an average face angle at impact with a golf ball. For example, display screen 700 shows the player 102 hit 50 golf balls with club type "Pa" having the alignment feature of FIG. 5A. The average golf club lie angle for those 50 balls was 0°, the average golf club loft angle for those 50 balls was 0°, and the average golf club face angle for those 50 balls was 1°.

Unless specified otherwise, a "golf club lie angle" is the lie angle of a golf club head relative to a baseline lie angle for the club head. In some embodiments, the baseline lie angle can be a club head's presented lie angle, which is the lie angle the club head was made to present at address on a playing surface. In some embodiments, the baseline lie angle can be a player-defined lie angle set by a player. In any case, the baseline lie angle can be programmed into one or more of a club head's electronic assembly 404, a player device 110, or host computer 150. A golf club lie angle, for example, the average golf club lie angles shown in FIG. 7, is the angle of tilt for a club head at impact with a golf ball and is defined by the angle between a hosel longitudinal axis of a golf club and the playing surface. A golf club lie angle, or average golf club lie angle, is indicative of a toc end or a heel end of the club being titled up or down at impact with a golf ball. A lie angle of 0° indicates the club head was at its baseline lie angle when it contacted the ball (i.e., the toe end and a heel end were not titled up or down). A negative lie angle, or a negative average line angle, can indicate that a toe end of a player's club was titled down at impact for one or more shots. A positive lie angle, or a positive average lie angle, can indicate that a toe of a player's club was pointed up at impact for one or more shots. In some embodiments, lie angle data can comprise an average value of the lie angles for multiple shots, a range of lie angles for multiple shots, a standard deviation for the lie angles of multiple shots, or a combination thereof.

Unless specified otherwise, a "golf club loft angle" is the loft angle of a golf club head relative to a baseline loft angle for the club head. In some embodiments, the baseline loft angle can be a club head's presented loft angle, which is the loft angle the club head was made to present at address on a playing surface. In some embodiments, the baseline loft angle can be a player-defined loft angle set by a player. In any case, the baseline loft angle can be programmed into one or more of a club head's electronic assembly 404, a player device 110, or host computer 150. A golf club loft angle, or an average golf club loft angle, is defined by the angle between the centerface normal vector and the ground plane when a club head is in a square face address position. A loft angle of 0° indicates that the club head struck the ball with the club face oriented at the baseline loft angle for that club head. In some embodiments, loft angle data can comprise an average value of the loft angles for multiple shots, a range of loft angles for multiple shots, a standard deviation for the loft angles of multiple shots, or a combination thereof. Unless specified otherwise, a "golf club face angle" is the face angle of a golf club head relative to a baseline face angle for the club head. In some embodiments, the baseline face angle can be a club head's presented face angle, which is the face angle the club head was made to present at address on a playing surface. In some embodiments, the baseline face angle can be a player-defined face angle set by a player. In any case, the baseline face angle can be programmed into one or more of a club head's electronic assembly 404, a player device 110, or host computer 150. A golf club face angle is defined by the horizontal component of the centerface normal vector and a vertical plane ("target line plane") that is normal to the vertical plane which contains a club head's shaft longitudinal axis when the shaft is in the correct lie and golf club's sole is resting on the playing surface (the club is in the grounded address position). A golf club face angle is indicative of a difference from the baseline face angle of the club head when it contacted the ball. A face angle of 0° indicates the club face was at the baseline face angle (for example, the club face was square) when it contacted the ball. A negative face angle, or a negative average face angle, can indicate that a player's club face was closed at impact for one or more shots. A positive face angle, or a positive average face angle, can indicate that a player's club face was open at impact for one or more shots. In some embodiments, face angle data can comprise an average value of the face angles for multiple shots, a range of face angles for multiple shots, a standard deviation for the face angles of multiple shots, or a combination thereof.

In some embodiments, a computer (for example, computer 114 or computer 150) of system 100 can be configured to display a recommendation on a display screen. In some embodiments, the recommendation can be a club fitting recommendation. For example, display screen 700 comprises a recommendation 710 for club type "Pb" having the alignment feature of FIG. 5K. The computer can make recommendation 710 based on, for example, the number of balls made, the average total distance 190, or both. In some embodiments, the recommendation can be a golf swing technique recommendation, a golf training drill recommendation, or both. For example, display screen 700 comprises a recommendation 712 for increasing the average golf club lie angle and the average golf club loft angle for wedge "Wa." The computer can make recommendation 712 based on, for example, the number of balls made, the average total distance 190, or both.

Figure 8:
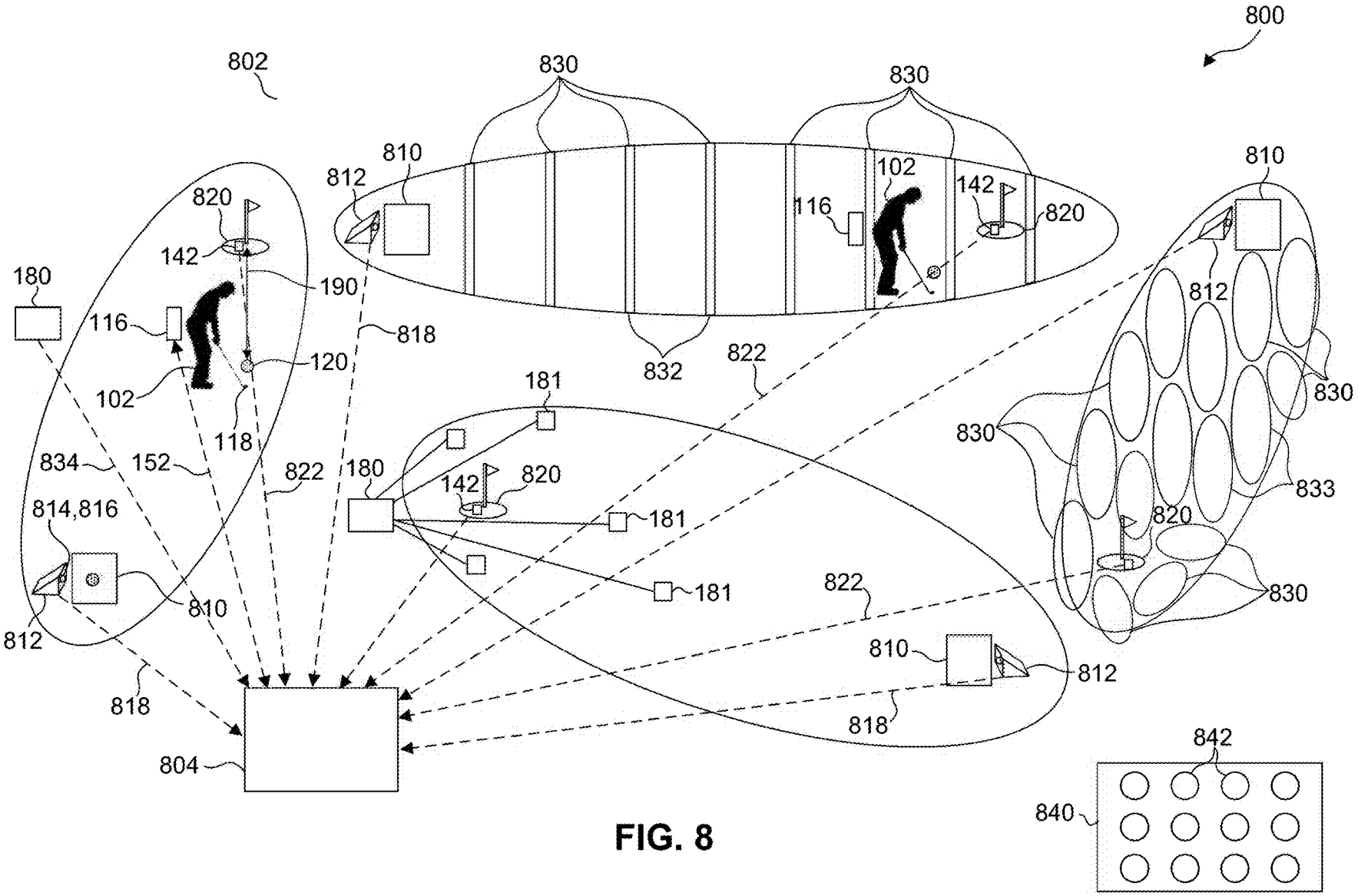
FIG. 8 illustrates a data integration system for an entertainment venue according to some embodiments.

In some embodiments, systems 100 and methods described herein can be implemented at a golf entertainment venue. FIG. 8 illustrates a system 800 and golf venue 802 comprising system 100 according to some embodiments.

As shown in FIG. 8, system 800 and venue 802 can comprise a plurality of teeing areas 810, a plurality of golf holes 820, and a venue computing system 804. Each teeing area 810 can comprise a respective teeing area electronic module 812. Each golf hole 820 can comprise a respective electronic module 142 as discussed herein. In some embodiments, the venue 802 can represent a golf putting green, a golf putting course, or a golf putting and chipping course, to provide some examples.

Electronic modules 812 comprise a transmitter 814 for transmitting one or more signals from teeing area 810 to other components of system 800. Exemplary transmitters 814 for electronic module 812 comprise, but are not limited to, transmitters comprising one or more circuits to connect to and communicate on wired and/or wireless networks. For example, this may include Wi-Fi, cellular, satellite, and/or other networks. In some embodiments, transmitters 814 can comprise one or more circuits (including a WLAN transceiver) to enable connection(s) and communication over WLAN networks such as, but not limited to, networks based on standards described in IEEE 802.11.

In some embodiments, electronic module 812 can comprise a receiver 816 for receiving one or more signals from other components of system 800. Exemplary receivers 816 for electronic module 812 comprise, but are not limited to, a radio-frequency receiver, a near-field-communication (NFC) receiver, a BLUETOOTH® receiver, a Wi-Fi receiver, UWB receiver, or a similar device for communicating with components of system 800.

In some embodiments, electronic modules 812 can identify golf ball identifiers 128 by identifying a wireless signal at the receiver 816, such as a radio frequency identification (RFID) signal, an NFC signal, a Wi-Fi signal, a UWB signal, or a BLUETOOTH® signal emitted from an electronic module 122 of ball 120. In some embodiments, electronic modules 812 can comprise a camera to optically identify an identifier 128 in the form of an optically identifiable image on the ball 120.

In some embodiments, electronic modules 812 can identify golf club identifiers 428 by identifying a wireless signal at the receiver 816, such as a radio frequency identification (RFID) signal, an NFC signal, a Wi-Fi signal, a UWB signal, or a BLUETOOTH® signal emitted from an electronic assembly 404 of golf club head 400. In some embodiments, electronic modules 812 can comprise a camera to optically identify an identifier 428 in the form of an optically identifiable image on the golf club head 400.

In some embodiments, electronic modules 812 can be configured to communicate with venue computing system 804 via communication paths 818. In such embodiments, communication paths 818 can be a wired or wireless communication path between an electronic module 812 and computing system 804.

In some embodiments, electronic modules 142 of golf holes 820 can be configured to communicate with venue computing system 804 via communication paths 822. In such embodiments, communication paths 822 can be a wired or wireless communication path between an electronic module 142 and computing system 804. The communication between electronic modules 142 of golf holes 820 and computing system 804 can be the same as the communication between electronic modules 142 of golf holes 140 and host computer 150 as discussed herein.

In some embodiments, each of golf balls 120 can comprise an identifier 128 that identifies each particular ball 120 to system 800. In some embodiments, venue 802 can register identifiers 128 of different golf balls to different players 102 within the venue 802. The identifiers 128 can be used by the venue 802 to identify which player is associated with a particular golf ball 120.

In some embodiments, venue computing system 804 can perform a golf ball registration procedure to register a golf ball 120 to a player 102. As part of the golf ball registration procedure, venue 802 can capture the identifiers 128 of the golf balls 120. In some embodiments, venue 802 can capture the identifiers 128 of the golf balls 120 at a teeing area 810. As part of the golf ball registration procedure, the venue computing system 804 can register the identifier 128 of golf balls 120 to individual players 102.

In some embodiments, as part of the golf ball registration procedure, the venue computing system 804 can store a golf ball registration database that maps the identifiers 128 to their associated players 102. The golf ball registration database can include a plurality of identifiers 128. In some embodiments, the venue computing system 804 can comprise one or more memories that store the golf ball registration database comprising each of the golf ball identifiers 128.

In some embodiments, system 800 can register a golf ball to player by capturing both the identifiers 128 of the golf balls 120 and identifiers 428 for golf clubs at a teeing area 810. In such embodiments, venue computing system 804 can comprise one or more processors configured to execute instructions stored in a memory, the instructions, when executed by the one or more processors, configure the one or more processors to register a golf ball identifier 128 with a player 102 at a teeing area 810 of the venue 802.

When a ball 120 comprising an identifier 128 arrives at a first one of the teeing areas 810, the instructions can configure the one or more processors to identify, by data received from a first one of the teeing area transmitters 814, a golf ball identifier 128 at the first teeing area 810. In some embodiments, teeing area electronic module 812 can identify the golf ball identifier 128 by identifying a wireless signal at the receiver 816, such as a radio frequency identification (RFID) signal, an NFC signal, a Wi-Fi signal, a UWB signal, or a BLUETOOTH® signal emitted from an electronic module 122 of ball 120. In some embodiments, teeing area electronic module 812 can comprise a camera to optically identify an identifier 128 in the form of an optically identifiable image on the ball 120.

Further, when the ball 120 comprising an identifier 128 arrives at a first one of the teeing areas 810, the instructions can configure the one or more processors to identify, by data received from a first one of the teeing area transmitters 814, an identifier 428 at the first teeing area 810. In some embodiments, teeing area electronic module 812 can identify the identifier 428 by identifying a wireless signal at the receiver 816, such as a radio frequency identification (RFID) signal, an NFC signal, a Wi-Fi signal, a UWB signal, or a BLUETOOTH® signal emitted from an electronic assembly 404 of club head 400. In some embodiments, teeing area electronic module 812 can comprise a camera to optically identify an identifier 428 in the form of an optically identifiable image on the club head 400.

After reading both the identifier 128 and the identifier 428, system 800 can register the golf ball 120 to a player associated with the club head 400. In such embodiments, venue computing system 804 can store a golf club registration database that maps the identifiers 428 to their associated players 102.

Teeing areas 810 represent areas within the venue 802 for players 102 to hit golf balls 120 at golf holes 820. In some embodiments, venue computing system 804 can perform a golf ball identification procedure to identify the player 102 that hit a particular golf ball 120 that arrives at a golf hole 820. As part of this golf ball identification procedure, the venue computing system 804 identifies identifiers 128 that arrive at golf holes 820 and determines the player 102 that is registered to the identifier 128 from the golf ball registration database. As an example, the venue computing system 804 can identify the identifier 128 of a ball 120 that arrives at a golf hole 820 and determine a particular player 102 is registered to the identifier 128 from the golf ball registration database.

Venue computing system 804 can comprise one or more processors configured to execute instructions stored in a memory, the instructions, when executed by the one or more processors, configure the one or more processors to register a first one of the golf ball identifiers 128 with a first player 102 at the venue 802.

When ball 120 comprising the first identifier 128 arrives at a first one of the teeing areas 810, the instructions can then configure the one or more processors to identify, by data received from a first one of the teeing area transmitters 814, the first golf ball identifier 128 at the first teeing area 810. In some embodiments, teeing area electronic module 812 can identify the first golf ball identifier 128 by identifying a wireless signal at the receiver 816, such as a radio frequency identification (RFID) signal, an NFC signal, a Wi-Fi signal, a UWB signal, or a BLUETOOTH® signal emitted from an electronic module 122 of ball 120. In some embodiments, teeing area electronic module 812 can comprise a camera to optically identify an identifier 128 in the form of an optically identifiable image on the ball 120.

When ball 120 comprising the first identifier 128 arrives at a first one of the golf holes 820, the instructions can then configure the one or more processors to identify, by data received from a first one of the transmitters 144 at the first golf hole 820, the first identifier 128 at the first golf hole 820. In some embodiments, electronic module 142 can identify the first identifier 128 by identifying a wireless signal at the receiver 146, such as a radio frequency identification (RFID) signal, an NFC signal, a Wi-Fi signal, a UWB signal, or a BLUETOOTH® signal emitted from an electronic module 122 of ball 120. In some embodiments, electronic module 142 can comprise a camera to optically identify an identifier 128 in the form of an optically identifiable image on the ball 120.

After identifying the first golf ball identifier 128 at the first hole 820, the instructions can then configure the one or more processors to receive a number of strokes taken between the first teeing area 810 and the first golf hole 820. In some embodiments, the instructions can configure the one or more processors to receive, from the first transmitter 144, the number of strokes taken between the first teeing area 810 and the first golf hole 820. After receiving the number of strokes taken, the instructions can configure the one or more processors to display the first player's score based on the number of strokes taken between the first teeing area 810 and the first golf hole 820. In some embodiments, the instructions can configure the one or more processors to display the first player's score on a display screen of a player device 110. In such embodiments, a player device 110 can be in communication with venue computing system 804 via a wired or wireless communication path, like communication path 152 described herein. As a non-limiting example, FIG. 10 shows a display screen 1000 comprising a scorecard 1010 showing a first player's (player A's) score on a first golf hole.

In some embodiments, the number of strokes taken between the first teeing area 810 and the first golf hole 820 can be calculated by an IMU sensor 126 located within the golf ball 120 comprising the first identifier 128. In such embodiments, the IMU sensor 126 can be configured to detect the number of strokes taken by detecting an impact between the ball 120 and a club face. In some embodiments, electronic module 142 can identify the number of strokes taken when reading the first identifier 128 at the first hole 820. In some embodiments, the transmitter 124 located within the golf ball 120 comprising the first identifier 128 can transmit the number of strokes taken between the first teeing area 810 and the first golf hole 820 to receiver 146 located at the first golf hole 820. For example, an NFC transmitter 124 or a UWB transmitter 124 can transmit the number of strokes taken via communication path 162.

In some embodiments, electronic module 122 can be configured to reset the number of strokes taken when electronic module 122 detects that the ball 120 is within the first golf hole 820. In some embodiments, after identifying the ball 120 at the first hole 820, the electronic module 142 at the first golf hole 820 can transmit a signal to the ball instructing the electronic module 122 to reset the number of strokes taken. In some embodiments, after identifying the ball 120 at the first hole 820, the electronic module 142 at the first golf hole 820 can transmit a signal to the ball instructing the electronic module 122 to reset the number of strokes taken and deactivate (for example, enter a sleep mode) until the ball 120 arrives at the next teeing area. In such embodiments, the next teeing area transmitter 814 can transmit a signal to the ball instructing the electronic module 122 to re-activate. In some embodiments, electronic module 122 can be configured to count a total number of shots taken at venue 802. In such embodiments, the number of shots taken between respective teeing areas 810 and holes 820 can be calculated by the total number of shots received at the receiver 146 of each respective hole 820.

In some embodiments, the number of strokes taken between the first teeing area 810 and the first golf hole 820 can be calculated by an IMU sensor of an electronic assembly 404 in a club head 400. In such embodiments, the IMU sensor of assembly 404 can be configured to detect the number of strokes taken by detecting an impact between the ball 120 and the club face of club head 400. In some embodiments, electronic module 812 of the next teeing area 810 can identify the number of strokes taken when reading the identifier 428 of the golf club head 400 at the next teeing area 810.

In some embodiments, electronic module 812 of the next teeing area 810 can be configured to reset the number of strokes taken when the electronic module 812 reads the identifier 428. In some embodiments, after identifying the club head 400 at the next teeing area 810, the electronic module 812 of the next teeing area 810 can transmit a signal to the club head 400 instructing the electronic assembly 404 to reset the number of strokes taken. In some embodiments, electronic assembly 404 can additionally be configured to count a total number of shots taken at venue 802.

As a non-limiting example for counting the number of strokes using an IMU sensor of an electronic assembly 404 in a club head 400, first identifier 128 can be optically identified at first teeing area 810 and at first golf hole 820, and the number of strokes taken between the first teeing area 810 and the first golf hole 820 can be calculated by the IMU sensor of an electronic assembly 404. Then, when the identifier 428 of golf club head 400 is read at a second teeing area 810, electronic module 812 of the second teeing area 810 can receive the number of strokes taken on the first golf hole. In such embodiments, stroke counting can be achieved without electronic modules 122 within the golf ball 120.

In some embodiments, the number of strokes taken between the first teeing area 810 and the first golf hole 820 can be calculated by determining changes in a resting location for the golf ball 120.

In some embodiments, changes in resting location can be determined based on a proximity sensor system comprising a plurality of proximity sensors 830 located around venue 802. In such embodiments, the proximity sensors 830 can be radio-frequency proximity sensors, such as RFID sensors or NFC sensors, configured to read a radio-frequency chip, for example an RFID chip or an NFC chip within balls 120. In some embodiments, the proximity sensors 830 can be radio-frequency proximity sensors configured to read an RFID signal transmitted from transmitter 124 of an electronic module 122 of golf ball 120. In some embodiments, the proximity sensors 830 can be NFC proximity sensors configured to read an NFC signal transmitted from transmitter 124 of an electronic module 122 of golf ball 120.

In embodiments comprising proximity sensors 830, the movement of a ball 120 can be tracked by sensing when the ball 120 moves to within a communication range of a particular proximity sensor 830. By positioning proximity sensors 830 at various locations between the first teeing area 810 and the first golf hole 820, the movement of a ball 120 can be tracked by sensing the ball 120 at consecutive proximity sensors 830. Proximity sensors 830 can determine a ball 120 is at rest if there is no significant change in positional data for more than the predetermined amount of time. The predetermined amount of time can be, for example, two seconds, three seconds, or four seconds.

In some embodiments, proximity sensors 830 can be arranged with consecutive communication ranges in the form of strips 832 extending from a right side of a golf course hole to a left side of the golf course hole. For example, proximity sensors 830 can be arranged in strips between a respective teeing area and golf hole. In such embodiments, proximity sensors 830 can track the movement of a ball 120 by sensing the ball as it passes over consecutive strips 832. And in such embodiments, system 800 can be configured to sense the ball 120 has come to rest by sensing the ball 120 at a single strip 832 for the predetermined time or by sensing that ball 120 has not been read by a strip 832 for the predetermined amount of time. In cases where system 800 senses a ball 120 at a single strip 832 for the predetermined amount of time, system 800 can be configured to determine the ball 120 has come to rest at a location within the communication range of the single strip 832. In cases where system 800 senses a ball 120 has not been read by a strip 832 for the predetermined amount of time, system 800 can be configured to determine the ball 120 has come to rest at a location between the last strip 832 that sensed the ball 120 and the next strip 832 in the row of consecutive strips 832. In some embodiments, the distance between strips 832 can decrease around a golf hole 820 to provide increased sensitivity in detecting resting locations for shorter golf shots.

In some embodiments, proximity sensors 830 can be arranged with communication ranges in the form of islands 833 arranged in a grid pattern along the length of a golf course hole. For example, proximity sensors 830 can be arranged in a grid between a respective teeing area and golf hole. In such embodiments, proximity sensors 830 can track the movement of a ball 120 by sensing the ball as it passes over consecutive islands 833. And in such embodiments, system 800 can be configured to sense the ball 120 has come to rest by sensing the ball 120 at a single island 833 for the predetermined time. When system 800 senses a ball 120 at a single island 833 for the predetermined amount of time, system 800 can be configured to determine the ball 120 has come to rest at a location within the communication range of the single island 833. In some embodiments, the area of adjacent islands 833 can decrease around a golf hole 820 to provide increased sensitivity in detecting resting locations for shorter golf shots.

In some embodiments comprising the proximity sensor system comprising a plurality of the proximity sensors 830, the proximity sensors 830 can be embedded within the ground of venue 802. For example, the proximity sensors 830 can be embedded within artificial turf at venue 802.

In some embodiments, system 800 can comprise a proximity sensor located at or within golf hole 820 and configured to assign a "gimme" shot to the player associated with a golf ball 120 when the golf ball is sensed by the proximity sensor located at or within golf hole 820. In such instances, when the golf ball 120 moves to within the communication range of the proximity sensor located at or within golf hole 820, system 800 can be configured to assign a "gimme" shot to the player associated with the golf ball 120.

In some embodiments, the last shot taken at any hole 820 can be determined when ball 120 comprising the first identifier 128 arrives at the hole 820 and the identifier is read by the hole electronic module 142. In the event the first golf ball identifier 128 is never sensed as arriving at the first golf hole 820 (or any subsequent golf hole 820) before being sensed at the second golf teeing area 810 (or any teeing area 810), system 800 can be configured to assign a "gimme" shot to the player associated with the golf ball comprising the first ball identifier 128. In such instances, when the first golf ball identifier 128 is identified by the second golf teeing area 810, receiver 816 at the second teeing area can receive the number strokes from the transmitter 124 of ball 120. Then, teeing area electronic module 812 or venue computing system 804 can add one "gimme" stroke to the number of strokes taken between the first teeing area 810 and the first golf hole 820.

In some embodiments, venue 802 can comprise a charging bin 840 comprising a plurality of NFC chargers 842 configured to charge the electronic modules 122 of balls 120 at venue 802. In such embodiments, the electronic modules 122 of balls 120 comprise an NFC chip capable of accepting a wireless charge from the NFC chargers.

In embodiments comprising identifiers 128 comprising an NFC chip, venue 802 can comprise a charging bin 840 comprising a plurality of NFC chargers 842 configured to charge the NFC chip of the plurality of balls 120. In some embodiments comprising identifiers 128 comprising an NFC chip, venue 802 can comprise a charging bin 840 comprising a plurality of NFC chargers 842 configured to charge the NFC chip of the plurality of balls 120 and other components of a ball electronic module 122. For example, in such embodiments, the NFC chargers 842 can be configured to charge the NFC chip of the plurality of balls 120 and the IMU sensor 126 of the plurality of golf balls 120.

In some embodiments, the electronics module 122 of balls 120 can comprise an NFC chip used solely for charging the electronic modules 122 of balls 120 and the identifier 128 may not comprise an NFC signal. For example, in such embodiments, the identifier 128 can be a unique graphical image.

In some embodiments, changes in resting location can be determined by a position sensor 180 comprising an array of radio-frequency position sensors 181, for example UWB sensors. In such embodiments, each sensor 181 in the array of radio-frequency position sensors 181 can be configured to read a corresponding radio-frequency position sensor within balls 120. In embodiments comprising an array of radio-frequency sensors 181, the movement of a ball 120 can be tracked by determining the location of a ball 120 relative to a plurality of radio-frequency position sensors 181 and then determining the location of the ball relative to golf hole 820 by multilateration. By positioning radio-frequency position sensors 181 at various locations between the first teeing area 810 and the first golf hole 820, the movement of a ball 120 can be tracked by sensing the ball 120 with a plurality of radio-frequency position sensors 181. Position sensor 180 comprising an array of sensors 181 can determine a ball 120 is at rest if there is no significant change in positional data received from the plurality of radio-frequency position sensors 181 for more than the predetermined amount of time. The predetermined amount of time can be, for example, two seconds, three seconds, or four seconds.

In some embodiments, system 800 can comprise a radio-frequency position sensor 181 located at or within golf hole 820 and configured to assign a "gimme" shot to the player associated with a golf ball 120 when the golf ball is sensed by the position sensor 181 located at or within golf hole 820. In such instances, when the golf ball 120 moves to within the communication range of the position sensor 181 located at or within golf hole 820, system 800 can be configured to assign a "gimme" shot to the player associated with the golf ball 120. In such embodiments, the position sensor can have a communication range of less than or equal a predetermined distance considered to be a "gimme" shot, for example less than or equal to 1 meter.

System 800 can repeat the process of identifying balls 120 at teeing areas 810, identifying balls 120 at golf holes 820, receiving the number of strokes taken between respective teeing areas 810 and holes 820, and displaying scores based on the number of strokes taken for any number of players and any number of golf holes located at venue 802. For example, the instructions can configure the one or more processors to (i) identify, by data received from a second one of the transmitters 814, the first identifier 128 at a second one of the teeing areas 810, (ii) identify, by data received from a second transmitter 144, the first identifier 128 at a second one of the golf holes 820, (iii) receive a number of strokes taken between the second teeing area 810 and the second golf hole 820, and (iv) display, on the display screen of a player device 110, the first player's score based on the number of strokes taken between the second teeing area 810 and the second golf hole 820. As another example, the instructions can configure the one or more processors to (i) identify, by data received from the first transmitter 814, a second identifier 128 at the first teeing area 810, (ii) identify, by data received from the first transmitter 144, the second identifier 128 at the first golf hole 820, (iii) receive, a number of strokes taken between the first teeing area 810 and the first golf hole 820, and (iv) display, on the display screen of a player device 110, a second player's score based on the number of strokes taken between the first teeing area 810 and the first golf hole 820.

Figure 9:
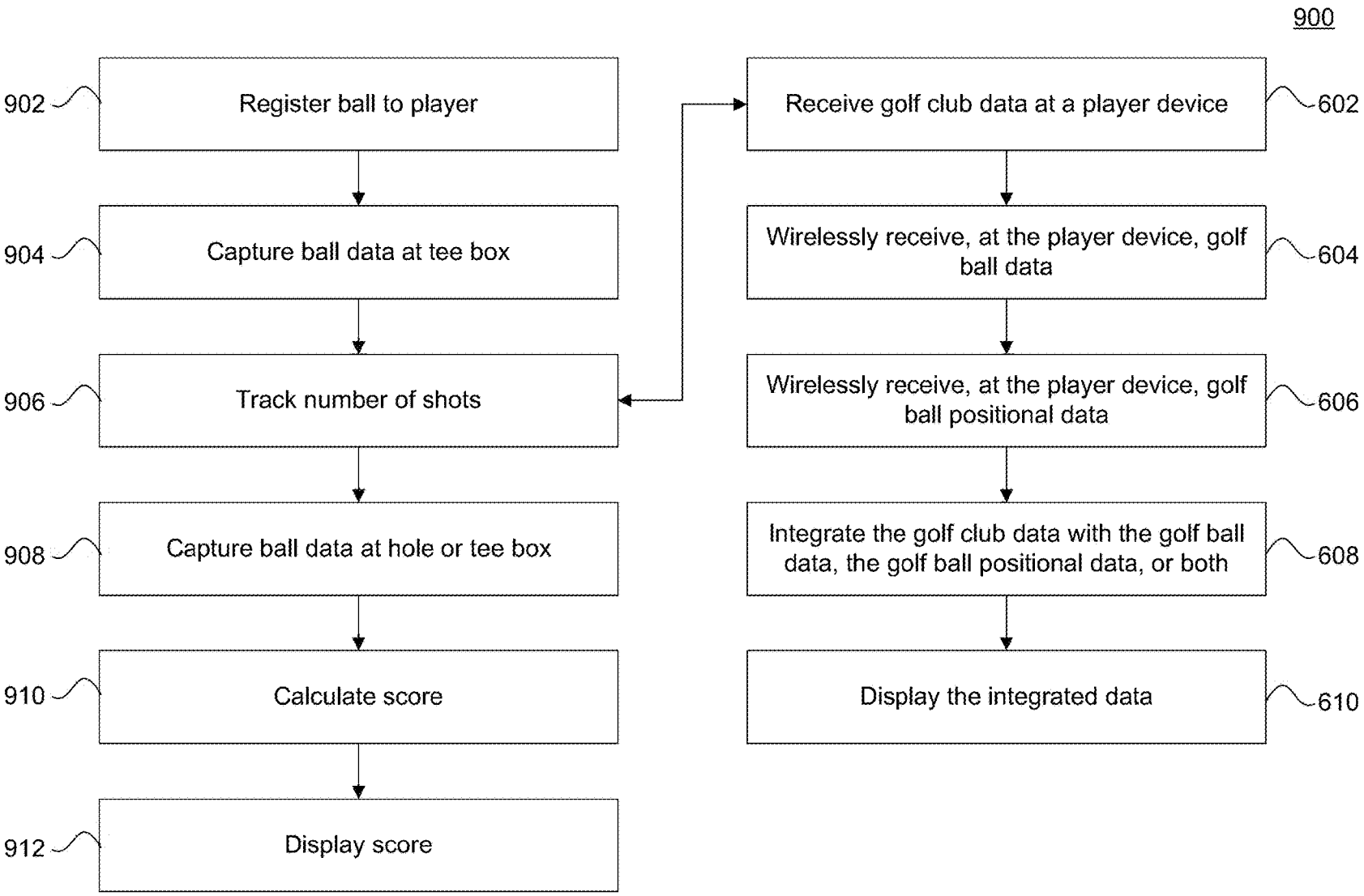
FIG. 9 is a flow chart illustrating a method of integrating data for an entertainment venue according to some embodiments.

FIG. 9 illustrates a method 900 of integrating data within system 800 according to some embodiments. The following discussion describes an exemplary operational control flow for registering golf balls 120 hit by players 102 within a venue, such as venue 802. The operational control flow can be executed by one or more computing devices, processors, controllers, systems, or other electrical, mechanical, and/or electro-mechanical devices executing firmware, software applications, routines, instructions, and/or the like within the golf entertainment venue, such as the venue computing system 804.

In step 902, venue computing system 804 can register a ball 120 to a player 102. In step 902, the operational control flow can perform a golf ball registration procedure to register an identifier 128 of a golf ball 120 to a player 102. In some embodiments, a player 102 can bring or purchase a golf ball 120 having a unique identifier 128. As part of step 902, computing system 804 can register the identifier 128 on the ball 120 to the player 102 in the golf ball registration database as described herein. In some embodiments, a player 102 can bring or purchase a golf club having a unique identifier 428. In such embodiments, as part of step 902, computing system 804 can register the identifier 128 on the ball 120 to the player 102 by reading identifier 428 as described herein.

In some embodiments, a first teeing area 810 can capture an identifier 128 and the venue computing system 804 can register the identifier 128 to a player 102 as part of the golf ball registration procedure as described herein. In some embodiments, the teeing area electronic module 812 can capture the identifier 128 before, as, or after the player 102 hits the golf ball 120 from the teeing area 810. In some embodiments, teeing area electronic module 812 can continuously, or near continuously, monitor the teeing area 810. Alternatively, or in addition to, the teeing area electronic module 812 can be triggered to monitor the teeing area 810. In such embodiments, the teeing area electronic module 812 can be triggered to capture the identifier in response to the golf ball 120 being placed onto a designated area on the teeing area 810.

In some embodiments, a first teeing area 810 can capture an identifier 428 and the venue computing system 804 can register the identifier 128 on a golf ball 120 to a player 102 as part of the golf ball registration procedure as described herein. In some embodiments, the teeing area electronic module 812 can capture the identifier 428 before, as, or after the player 102 hits the golf ball 120 from the teeing area 810. In some embodiments, teeing area electronic module 812 can continuously, or near continuously, monitor the teeing area 810. Alternatively, or in addition to, the teeing area electronic module 812 can be triggered to monitor the teeing area 810.

In step 904, venue computing system 804 can capture ball data at a teeing area 810. The ball data can comprise the identifier 128 of a golf ball 120. In some embodiments, the teeing area 810 can capture the identifier 128 and send identification data to venue computing system 804 via communication path 818 to identify the identifier 128 at the teeing area 810. In some embodiments, the teeing area electronic module 812 can capture the identifier 128 before, as, or after a player 102 hits a golf ball 120 from the teeing area 810. In some embodiments, teeing area electronic module 812 can continuously, or near continuously, monitor the teeing area 810. Alternatively, or in addition to, the teeing area electronic module 812 can be triggered to monitor the teeing area 810. In such embodiments, the teeing area electronic module 812 can be triggered to capture the identifier in response to the golf ball 120 being placed onto a designated area on the teeing area 810.

Each teeing area 810 within venue 802 can be configured to preform step 904 when a ball 120 comprising an identifier 128 arrives at each respective teeing area 810. By capturing the identifier 128 of each ball 120 that arrives at each teeing area 810, system 800 can identify when a ball 120 registered for each particular player 102 at venue 802 arrives at each respective teeing area 810.

In step 906, system 800 tracks the number of shots taken once a player hits a golf ball 120 from a teeing area 810. In some embodiments, system 800 can track the number of shots using IMU sensors 126 located within the golf balls 120. In some embodiments, electronic modules 142 can identify the number of strokes taken when reading identifiers 128 at golf holes 820. In some embodiments, the transmitters 124 located within the golf balls 120 can transmit the number of strokes taken via communication path 162 when balls 120 arrive at holes 820. In some embodiments, system 800 can track the number of shots using IMU sensors located within golf club heads 400. In such embodiments, electronic modules 812 can identify the number of strokes taken when reading identifiers 428 at teeing areas 810. In some embodiments, proximity sensors 830 within system 800 can track the number of shots taken by determining changes in a resting location for a golf ball 120 as discussed herein. In some embodiments, a position sensor 180 comprising an array of radio-frequency position sensors 181 within system 800 can track the number of shots taken by determining changes in a resting location for a golf ball 120 as discussed herein.

In some embodiments, step 906 can comprise integrating golf club data, golf ball data, and/or golf ball positional data according to method 600 described herein. In such embodiments, method 900 can comprise steps 602, 604, 606, 608, and 610 as described herein. In some embodiments, system 800 can perform steps 602, 604, 606, 608, and 610 for only a player's first shot from each respective teeing area 810 using a position sensor 180 having a field of view surrounding an individual golf hole 820. By integrating golf club data, golf ball data, and/or golf ball positional data for only a player's first shot, a player can assess their performance with particular club type, alignment feature, or both. In some embodiments, system 800 can performs steps 602, 604, 606, 608, and 610 for each shot taken by a player. By integrating golf club data, golf ball data, and/or golf ball positional data for each shot taken by a player, system 800 can integrate and display one or more statistics for a group of players at a venue. For example, FIG. 10 shows a display screen 1000 comprising a score card 1010 showing the longest shot made 1012 at venue 802 for a plurality of players 102.

In embodiments comprising position sensors 180 for respective holes 820, the position sensors 180 can communicate with venue computing system 804 via a communication path 834. Venue computing system 804 can be communicatively coupled to position sensors 180 using any suitable wired or wireless communication method, such as Universal Serial Bus (USB), BLUETOOTH®, Wi-Fi, or another communication protocol. In some embodiments, multiple different communication protocols can be used concurrently.

In step 908, venue computing system 804 can capture ball data. The ball data can comprise the identifier 128 of a golf ball 120 and the number of shots taken between the teeing area 810 that captured the ball data in step 904 and the hole 820. In embodiments comprising step 604, ball data captured at a golf hole 820 can comprise golf ball launch data. In some embodiments, ball data can be captured at a golf hole 820. In such embodiments, the golf hole 820 can capture the identifier 128 and send identification data to venue computing system 804 via communication path 822 to identify the identifier 128 at the golf hole 820. In some embodiments, the electronic module 142 at golf hole 820 can capture the identifier 128 once ball 120 comes to rest within the hole 820. In some embodiments, ball data can be captured at a teeing area 810. For example, in some embodiments, the number of shots taken between the teeing area 810 that captured the ball data in step 904 and the hole 820 can be determined by reading an identifier 428 at the next teeing area 810.

In some embodiments, each golf hole 820 within venue 802 can be configured to preformed step 908 when a ball 120 comprising an identifier 128 arrives at each respective hole 820. By capturing the identifier 128 of each ball 120 that arrives at each golf hole 820, system 800 can identify when a ball registered for each particular player 102 arrives at each respective hole 820 within venue 802. In some embodiments, each teeing area 810 within venue 802 can be configured to preformed step 908 when a ball 120 comprising an identifier 128 and a golf club comprising an identifier 428 arrives at each respective teeing area 810. By capturing the identifier 128 of each ball 120 and the identifier 428 of each golf club that arrives at each teeing area 810, system 800 can identify when a ball registered for each particular player 102 arrives at each respective teeing area 810 within venue 802.

In step 910, venue computing system 804 can calculate a score for a player registered to the identifier 128 on the ball 120 based on the number of shots taken between the teeing area 810 that captured the ball data in step 904 and the hole 820. In the event a golf ball 120 comprising a particular identifier 128 is never sensed as arriving at a golf hole 820 before being sensed at the next golf teeing area 810, step 910 can comprise assigning a "gimme" shot to the player associated with the golf ball 120. In such instances, when the golf ball comprising the particular identifier 128 is identified by the next golf teeing area 810, receiver 816 at the second teeing area can receive the number strokes from the transmitter 124 of ball 120. Then, teeing area electronic module 812 or venue computing system 804 can add one "gimme" stroke to the number of strokes taken between a certain teeing area 810 and golf hole 820.

In step 912, venue computing system 804 can display the player's score on a display screen. In some embodiments, the display screen can be the display screen 112 of a player device 110. In embodiments comprising step 610, both player's score and player statistics can be displayed on the display screen.

FIG. 10 illustrates an exemplary display screen 1000 showing multiple players' scores calculated by venue computing system 804. Display screen 1000 comprises a score card 1010 showing four players' (players A-D) scores. For example, as shown, venue computing system 804 calculated that player A had a score of "3" on a first hole at the venue 802, a score of "2" on a second hole at the venue 802, and a score of "1" on a third hole at the venue 802. Further, venue computing system 804 calculated that player A had a total score of "50" for a round of holes played at venue 802. In some embodiments, score card 1010 can be a leader board for a particular day or event at venue 802.

Display screen 1000 also shows exemplary player statistics that can be displayed. Display screen shows player A's statistics screen 701 showing golf club data, golf ball data, and golf swing data for player A during the round of holes played at venue 802. The statistics screen shows the data for only the player A's first shot at each hole during the round of holes. In some embodiments, display screen 1000 can display a particular statistic for each player. For example, display screen can display a longest shot made 1012 by each player during the round of holes. Venue computing system 804 can be configured to integrate and display this data based on golf ball positional data collected for each player during the round.

Figure 11:
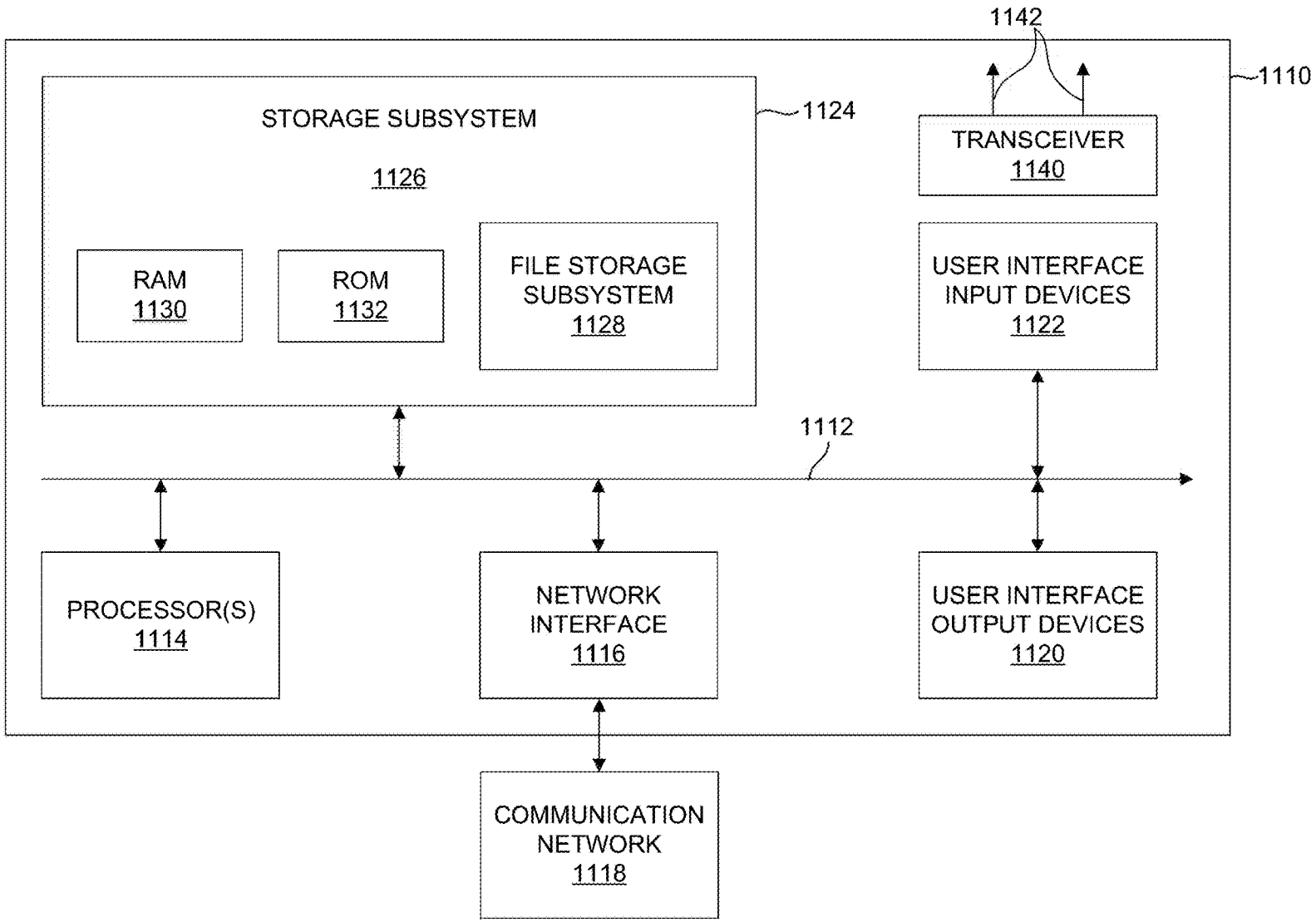
FIG. 11 illustrates a computer system suitable for use with embodiments described herein according to some embodiments.

FIG. 11 illustrates a simplified block diagram of a computer system suitable for use with embodiments described herein according to embodiments of the present disclosure. The various electronic devices, for example, computer 114, computer 150, electronic modules 122, electronic modules 142, electronic assembly 404, teeing area electronic modules 812, and venue computing system 804 can be implemented in hardware, firmware, software, or any combination thereof. The discussion of FIG. 11 to follow describes an exemplary computer system 1110 that can be used for these electronic devices.

In the exemplary embodiment illustrated in FIG. 11, the computer system 1110 typically comprises at least one processor 1114 that communicates with a number of peripheral devices via bus subsystem 1112. Typically, the at least processor 1114 can comprise, or can be, any of a microprocessor, graphics processing unit, or digital signal processor, and their electronic processing equivalents, such as an Application Specific Integrated Circuit ("ASIC") or Field Programmable Gate Array ("FPGA"). As used herein, the term "processor" signifies a tangible data and information processing device that physically transforms data and information, typically using a sequence transformation (also referred to as "operations"). Data and information can be physically represented by an electrical, magnetic, optical or acoustical signal that is capable of being stored, accessed, transferred, combined, compared, or otherwise manipulated by the processor. The term "processor" can signify a singular processor and multi-core systems or multi-processor arrays, including graphic processing units, digital signal processors, digital processors or combinations of these elements. The processor can be electronic, for example, comprising digital logic circuitry (for example, binary logic), or analog (for example, an operational amplifier). The processor can also operate to support performance of the relevant operations in a "cloud computing" environment or as a "software as a service" (SaaS). For example, at least some of the operations may be performed by a group of processors available at a distributed or remote system, these processors accessible via a communications network (e.g., the Internet) and via one or more software interfaces (e.g., an application program interface (API).)

The computer system typically includes an operating system, such as Microsoft's Windows, Sun Microsystems's Solaris, Apple Computer's MacOs, Linux, UNIX, Android, or iOS. The computer system also typically can include a Basic Input/Output System (BIOS) and processor firmware. The operating system, BIOS and firmware are used by the processor to control subsystems and interfaces coupled to the processor. Typical processors compatible with these operating systems include the Pentium and Itanium from Intel, the Opteron and Athlon from Advanced Micro Devices, and the ARM processor from ARM Holdings.

As illustrated in FIG. 11, peripheral devices may include a storage subsystem 1124, comprising a memory subsystem 1126 and a file storage subsystem 1128, user interface input devices 1122, user interface output devices 1120, and a network interface subsystem 1116. The input and output devices allow user interaction with computer system 1110. In the exemplary embodiment illustrated in FIG. 11, the network interface subsystem 1116 provides an interface to outside networks, including an interface to a communication network 1118, and is coupled via a communication network 1118 to corresponding interface devices in other computer systems or machines. The communication network 1118 can comprise many interconnected computer systems, machines and communication links. These communication links may be wired links, optical links, wireless links, or any other devices for communication of information. The communication network 1118 can be any suitable computer network, for example a wide area network such as the Internet, and/or a local area network such as Ethernet. The communication network 1118 can be wired and/or wireless, and the communication network can use encryption and decryption methods, such as is available with a virtual private network. The communication network uses one or more communications interfaces, which can receive data from, and transmit data to, other systems. Embodiments of communications interfaces typically include an Ethernet card, a modem (e.g., telephone, satellite, cable, or ISDN), (asynchronous) digital subscriber line (DSL) unit, Firewire interface, USB interface, and the like. One or more communications protocols can be used, such as HTTP, TCP/IP, RTP/RTSP, IPX and/or UDP.

In some embodiments, computer system 1110 can comprise one or more transceivers 1140 and/or antennas 1142. Processor 1114 can communicate with transceiver 1140 and/or antennas 1142. Transceiver 1140 can generate radio signals that can be transmitted via antennas 1142. Transceiver 1140 can include one or more transmitters and/or receivers that transmit and receive communications signals. For example, this can comprise communication signals communicating with host computer 150, and/or player device 110. Signals can be communicated via antennas 1142. Antennas 1142 can comprise one or more antennas that may be the same or different types.

The one or more transceivers 1140 can comprise processors, controllers, radios, sockets, plugs, buffers, and like circuits/devices used for connecting to and communication on networks. According to some embodiments, the one or more transceivers 1140 comprise one or more circuits to connect to and communicate on wired and/or wireless networks. For example, this may include Wi-Fi, cellular, satellite, and/or other networks. In some embodiments, the one or more transceivers 1140 can comprise one or more circuits (including a WLAN transceiver) to enable connection(s) and communication over WLAN networks such as, but not limited to, networks based on standards described in IEEE 802.11. Additionally, or alternatively, the one or more transceivers 1140 can comprise one or more circuits (including a BLUETOOTH® transceiver) to enable connection(s) and communication based on, for example, BLUETOOTH® protocol, the BLUETOOTH® Low Energy protocol, or the BLUETOOTH® Low Energy Long Range protocol. For example, transceiver 1140 can comprise a BLUETOOTH® transceiver. Additionally, or alternatively, the one or more transceivers 1140 can comprise one or more circuits to enable connection(s) and communication based on, for example, a radio-frequency protocol, for example a near-field-communication (NFC) protocol.

The user interface input devices 1122 may include an alphanumeric keyboard, a keypad, pointing devices such as a mouse, trackball, touchpad, stylus, or graphics tablet, a scanner, a touchscreen incorporated into the display, audio input devices such as voice recognition systems or microphones, image capture devices, and other types of input devices. Such devices can be connected by wire or wirelessly to a computer system. In general, use of the term "input device" is intended to include all possible types of devices and ways to input information into the computer system 1110 or onto the communication network 1118. The user interface input devices 1122 can allow a user to select objects, icons, text and the like that appear on some types of user interface output devices, for example, a display subsystem. In some embodiments, user interface input devices 1122 can comprise one or more sensors (for example, an IMU sensor).

The user interface output devices 1120 may include a display subsystem, a printer, a fax machine, or non-visual displays such as audio output devices. The display subsystem may include a cathode ray tube (CRT), a flat-panel device such as a liquid crystal display (LCD), a projection device, or some other device for creating a visible image such as a virtual reality system. The display subsystem may also provide non-visual display such as via audio output or tactile output (e.g., vibrations) devices. In general, use of the term "output device" is intended to include all possible types of devices and ways to output information from the computer system 1110 to the user or to another machine or computer system.

The memory subsystem 1126 typically includes a number of memories including a main random-access memory ("RAM") 1130 (or other volatile storage device) for storage of instructions and data during program execution and a read only memory ("ROM") 1132 in which fixed instructions are stored. The file storage subsystem 1128 provides persistent storage for program and data files, and may include a hard disk drive, a floppy disk drive along with associated removable media, a CD-ROM drive, an optical drive, a flash memory, or removable media cartridges. The databases and modules implementing the functionality of certain embodiments may be stored by file storage subsystem 1128.

The bus subsystem 1112 provides a device for letting the various components and subsystems of the computer system 1110 communicate with each other as intended. Although the bus subsystem 1112 is shown schematically as a single bus, alternative embodiments of the bus subsystem may use multiple busses. For example, RAM-based main memory can communicate directly with file storage systems using Direct Memory Access ("DMA") systems.

Embodiments of the disclosure can be implemented in hardware, firmware, software application, or any combination thereof. Embodiments of the disclosure can also be implemented as instructions stored on a machine-readable medium, which can be read and executed by one or more processors. A machine-readable medium can include any mechanism for storing or transmitting information in a form readable by a machine (e.g., a computing circuitry). For example, a machine-readable medium can include non-transitory machine-readable mediums such as read only memory (ROM); random access memory (RAM); magnetic disk storage media; optical storage media; flash memory devices; and others. As another example, the machine-readable medium can include transitory machine-readable medium such as electrical, optical, acoustical, or other forms of propagated signals (e.g., carrier waves, infrared signals, digital signals, etc.). Further, firmware, software application, routines, instructions can be described herein as performing certain actions. However, it should be appreciated that such descriptions are merely for convenience and that such actions in fact result from computing devices, processors, controllers, or other devices executing the firmware, software application, routines, instructions, etc.

While various embodiments have been described herein, they have been presented by way of example, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present disclosure. The elements of the embodiments presented herein are not necessarily mutually exclusive, but can be interchanged to meet various situations as would be appreciated by one of skill in the art.

Embodiments of the present disclosure are described in detail herein with reference to embodiments thereof as illustrated in the accompanying drawings, in which like reference numerals are used to indicate identical or functionally similar elements. References to "one embodiment," "an embodiment," "some embodiments," "in certain embodiments," etc., indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The examples are illustrative, but not limiting, of the present disclosure. Other suitable modifications and adaptations of the variety of conditions and parameters normally encountered in the field, and which would be apparent to those skilled in the art, are within the spirit and scope of the disclosure.

It is to be understood that the phraseology or terminology used herein is for the purpose of description and not of limitation. The breadth and scope of the present disclosure should not be limited by any of the above-described exemplary embodiments, but should be defined in accordance with the following claims and their equivalents.

What is claimed is:

1. A system for integrating data at a golf entertainment venue, the system comprising:

a plurality of teeing areas, each of the respective teeing areas comprising a respective teeing area transmitter;

a plurality of golf holes, each of the respective golf holes comprising a respective hole transmitter;

a plurality of golf balls, each golf ball comprising a golf ball identifier and an inertial measurement unit (IMU) sensor;

one or more memories that store a golf ball registration database, the golf ball registration database comprising each of the golf ball identifiers; and one or more processors configured to execute instructions stored in the one or more memories, the instructions, when executed by the one or more processors, configuring the one or more processors to:

register a first one of the golf ball identifiers with a first player at the golf entertainment venue;

identify, by data received from a first one of the teeing area transmitters, the first golf ball identifier at a first one of the teeing areas within the golf entertainment venue;

identify, by data received from a first one of the hole transmitters, the first golf ball identifier at a first one of the golf holes within the golf entertainment venue;

receive data while the golf ball comprising the first golf ball identifier is between the first teeing area and the first golf hole, the received data being received from at least: (i) the IMU sensor of the golf ball comprising the first golf ball identifier and (ii) a position sensor configured to determine a location of the golf ball, wherein the received data comprises a timestamp received from the IMU sensor and a timestamp received from the position sensor;

correlate the data received from the IMU sensor and the position sensor at least in part by correlating the timestamps;

receive a number of strokes taken between the first teeing area and the first golf hole; and display, on a display screen of a player device, the first player's score based on the number of strokes taken between the first teeing area and the first golf hole.

2. The system of claim 1, wherein the instructions, when executed by the one or more processors, configure the one or more processors to:

identify, by data received from a second one of the teeing area transmitters, the first golf ball identifier at a second one of the teeing areas within the golf entertainment venue;

identify, by data received from a second one of the hole transmitters, the first golf ball identifier at a second one of the golf holes within the golf entertainment venue;

receive additional data while the golf ball comprising the first golf ball identifier is between the second teeing area and the second golf hole, the additional received data being received from at least: (i) the IMU sensor of the golf ball comprising the first golf ball identifier and (ii) an additional position sensor configured to determine a location of the golf ball, wherein the additional received data comprises an additional timestamp received from the IMU sensor and an additional timestamp received from the additional position sensor;

correlate the additional data received from the IMU sensor and the additional position sensor at least in part by correlating the additional timestamps;

receive a number of strokes taken between the second teeing area and the second golf hole; and display, on the display screen of the player device, the first player's score based on the number of strokes taken between the second teeing area and the second golf hole.

3. The system of claim 1, wherein the number of strokes taken between the first teeing area and the first golf hole is calculated by the IMU sensor located within the golf ball comprising the first golf ball identifier, and wherein a ball transmitter located within the golf ball comprising the first golf ball identifier transmits the number of strokes taken between the first teeing area and the first golf hole to a receiver located at the first golf hole.

4. The system of claim 1, wherein the system comprises a proximity sensor system configured to determine changes in a resting location of the golf ball comprising the first golf ball identifier, and wherein the number of strokes taken between the first teeing area and the first golf hole is calculated by determining changes in the resting location.

5. The system of claim 4, wherein the proximity sensor system comprises a plurality of radio-frequency proximity sensors arranged in a grid between the first teeing area and the first golf hole.

6. The system of claim 1, further comprising: a computer comprising one or more processors configured to execute instructions, the instructions, when executed by the computer, configuring the computer to:

receive golf club data from the player device, receive golf ball data from the golf ball comprising the first golf ball identifier, receive golf ball positional data from the position sensor, or both, integrate the golf club data with the golf ball data, the golf ball positional data, or both, and display the integrated data on the display screen of the player device.

7. The system of claim 6, wherein the player device is a mobile computing device carried by a player.

8. The system of claim 7, further comprising a golf club carried by the first player, the golf club comprising a club sensor configured to measure swing data for the first player's golf swing, and a club transmitter configured to transmit the swing data to the player device.

9. The system of claim 8, wherein the club sensor comprises an IMU sensor and the swing data comprises one or more of: a golf club lie angle at address, a golf club loft angle at address, a golf club face angle at address, a golf club lie angle at impact with a golf ball, a golf club loft angle at impact with a golf ball, a golf club face angle at impact with a golf ball, a golf club swing path, a swing tempo, a back swing duration, a swing transition rate, a swing width, or a club head rotation.

10. The system of claim 9, wherein the integrated data further comprises one or more of: the golf club lie angle at address, the golf club loft angle at address, the golf club face angle at address, the golf club lie angle at impact with a golf ball, the golf club loft angle at impact with a golf ball, the golf club face angle at impact with a golf ball, the golf club swing path, the swing tempo, the back swing duration, the swing transition rate, the swing width, or the club head rotation.

11. The system of claim 1, wherein the data received from the hole transmitter comprises data indicating a distance between the ball comprising the first golf ball identifier and the first golf hole.

12. The system of claim 1, wherein the hole transmitter is disposed in the golf hole.

13. The system of claim 1, wherein the hole transmitter is coupled to a flag disposed in the golf hole.

14. The system of claim 1, wherein the golf ball identifiers comprise an NFC chip, and wherein each of the plurality of golf holes comprises an NFC receiver configured to read an NFC signal from the NFC chip of each golf ball.

15. The system of claim 14, wherein the system comprises a proximity sensor system comprising a plurality of NFC sensors configured to determine changes in a resting location of the plurality of golf balls, and wherein the number of strokes taken between the first teeing area and the first golf hole is calculated by determining changes in the resting location by sensing the NFC chip of the golf ball comprising the first golf ball identifier at one or more of the plurality of NFC sensors.

16. A system for integrating data at a golf entertainment venue, the system comprising:

a plurality of golf balls, each golf ball comprising a golf ball identifier comprising an NFC chip;

a plurality of teeing areas, each of the respective teeing areas comprising: a respective teeing area NFC receiver configured to read the NFC chips and a respective teeing area transmitter;

a plurality of golf holes, each of the respective golf holes comprising: a respective hole NFC receiver configured to read the NFC chips and a respective hole transmitter;

one or more memories that store a golf ball registration database, the golf ball registration database comprising each of the golf ball identifiers; and one or more processors configured to execute instructions stored in the one or more memories, the instructions, when executed by the one or more processors, configuring the one or more processors to:

register a first one of the golf ball identifiers with a first player at the golf entertainment venue;

identify, by data received from a first one of the teeing area transmitters, the first golf ball identifier at a first one of the teeing areas within the golf entertainment venue;

identify, by data received from a first one of the hole transmitters, the first golf ball identifier at a first one of the golf holes within the golf entertainment venue;

receive data while the golf ball comprising the first golf ball identifier is between the first teeing area and the first golf hole, the received data being received from at least: (i) the NFC chip of the golf ball comprising the first golf ball identifier; (ii) the teeing area NFC receiver; (iii) the hole NFC receiver; and (iv) a position sensor configured to determine a location of the golf ball, wherein the received data comprises a timestamp received from each of the NFC chip of the golf ball, the teeing area NFC receiver, the hole NFC receiver, and the position sensor;

correlate the data received from the NFC chip of the golf ball, the teeing area NFC receiver, the hole NFC receiver, and the position sensor by correlating the timestamps;

receive a number of strokes taken between the first teeing area and the first golf hole; and display, on a display screen of a player device, the first player's score based on the number of strokes taken between the first teeing area and the first golf hole.

17. The system of claim 16, wherein the system comprises a proximity sensor system comprising a plurality of NFC sensors configured to determine changes in a resting location of the plurality of golf balls, and wherein the number of strokes taken between the first teeing area and the first golf hole is calculated by determining changes in the resting location by sensing the NFC chip of the golf ball comprising the first golf ball identifier at one or more of the plurality of NFC sensors.

18. The system of claim 16, wherein the number of strokes taken between the first teeing area and the first golf hole is calculated by an IMU sensor located within the golf ball comprising the first golf ball identifier, and wherein a ball transmitter located within the golf ball comprising the first golf ball identifier transmits the number of strokes taken between the first teeing area and the first golf hole to a receiver located at the first golf hole.

19. The system of claim 18, wherein the system comprises a charging bin comprising a plurality of NFC chargers configured to charge the NFC chip and the IMU sensor of each of the plurality of golf balls.

* * * * *